US005733053A

United States Patent [19]

Sasaki et al.

[11] Patent Number: 5,733,053

[45] Date of Patent: Mar. 31, 1998

[54] THERMAL TRANSFER PRINTING APPARATUS

[75] Inventors: Naotaka Sasaki; Shunichi Kawamata; Kenji Sugaya, all of Gunma, Japan

[73] Assignee: Japan Servo Co., Ltd., Tokyo, Japan

[21] Appl. No.: 610,402

[22] Filed: Mar. 4, 1996

[30] Foreign Application Priority Data

May 10, 1995 [JP] Japan ..... 7-135773

[51] Int. Cl.[6] ..... B41J 35/22

[52] U.S. Cl. ..... 400/120.02; 400/171; 400/206.2

[58] Field of Search ..... 400/120.1, 208, 400/206.2, 120.02, 171

[56] References Cited

U.S. PATENT DOCUMENTS

| | | | |
|---|---|---|---|
| 4,569,608 | 2/1986 | Watanabe | 400/208 |
| 4,622,563 | 11/1986 | Watanabe | 400/206.2 |
| 4,898,484 | 2/1990 | Aoyagi et al. | 400/120 |
| 5,030,969 | 7/1991 | Kaneko et al. | 346/76 |

FOREIGN PATENT DOCUMENTS

| | | | |
|---|---|---|---|
| 0184234 | 6/1986 | European Pat. Off. | 400/206.2 |
| 2-155678 | 6/1990 | Japan . | |

*Primary Examiner*—John S. Hilten

*Attorney, Agent, or Firm*—Nilles & Nilles, S.C.

[57] ABSTRACT

A thermal transfer printing apparatus has an improved ink sheet interchanging device. A fusion type or sublimation type thermal transfer printing using a combination of many kinds of ink sheets can be carried out by a single printing apparatus. A desired ink sheet cassette or ink sheet is selected by a carrier from a plurality of ink sheet cassettes each having an ink sheet, and moved in the recording paper transfer direction to a printing portion. A plurality of ink sheet cassettes are arranged at the up-stream side and down-stream side of the cassette transferring direction with respect to the printing portion or stacked at either one of the up-stream side and the down-stream side of the cassette transferring direction. Each of the ink sheet cassettes includes a supply core and a take-up core of the ink sheet arranged horizontally or vertically, and each of the take-up cores is transferred from the ink sheet cassette over the printing portion and returned to the ink sheet cassette after the printing.

15 Claims, 19 Drawing Sheets

THERMAL TRANSFER PRINTING APPARATUS

BACKGROUND OF THE INVENTION

1. Field of the Invention

This invention relates to a thermal transfer printing apparatus, and more particularly, relates to a thermal transfer printing apparatus having an improved ink sheet interchanging drive for use in a fusion type or sublimation type thermal transfer printing using a combination of many kinds of ink sheets, which is carried out by a single printing apparatus, wherein a desired ink sheet cassette is selected from a plurality of ink sheet cassettes each having an ink sheet and moved or extended to a printing portion.

2. Description of the Prior Art

As a conventional thermal transfer printing apparatus with a plurality of interchangeable ink sheets, (1) the Japanese Patent Laid-Open Publication No. 155678/1990, (2) U.S. Pat. No. 4,569,608, (8) U.S. Pat. No. 4,898,484 and (4) U.S. Pat. No. 5,030,969 are disclosed. The ink sheet interchangeable systems of the thermal transfer printing apparatus in said prior art will be explained as following.

(1) In the system of the thermal transfer printing apparatus disclosed in the Japanese Patent Laid-Open Publication No. 155678/1990, supply rolls and take-up rolls for a plurality of mono-color ink sheets are stored in a sheet stock portion arranged at an up-stream or down-stream side of the roll forwarding direction with respect to a recording portion composed of a thermal head and a platen roller as shown in FIG. 1 of said publication, so that 1) an ink sheet of required color and a holding portion for holding a take-up roll for said ink sheet of said required color are held, 2) the ink sheet is spread over the printing portion for printing, and 3) the ink sheet take-up roll is returned to the sheet stock portion after the printing.

In the ink sheet selection system, a required ink sheet is picked up by the sheet selection device by moving the ink sheet stock portion in the vertical direction.

(2) In the printing apparatus of said U.S. Pat. No. 4,569,608, ink sheet cassettes (each including an ink sheet having ink regions of yellow, magnet, cyan and black arranged side by side each of which regions corresponds substantially to the printing area) are stored in a cassette holding unit so that the take-up axis of the ink sheet is in parallel to the printing portion, the cassette holding unit being arranged beside the recording portion composed of a thermal head and a platen roller. The printing is carried out by sliding and moving a desired ink sheet cassette in parallel to the line of heating elements in the thermal head toward the printing portion. The ink sheet cassette moved to the printing portion can be returned to said cassette holding unit when desired.

(3) In the thermal transfer printer of said U.S. Pat. No. 4,898,484, a plurality of ink sheet cassettes are stored in a drum, and the take-up roll of the stored ink sheet is connected to a cassette plate held rotatably by the drum shaft. Further, the ink sheet cassette is moved so that the supply roll side of the ink sheet is transferred to the recording portion while rotating the cassette plate around the drum shaft, and the ink sheet cassette is returned in the drum after the printing. Further, in the modified embodiment, a plurality of ink sheet cassettes are fixed to an endless belt over the printing portion, and one ink sheet cassette including a desired ink sheet therein is moved to the printing portion by driving the belt by a motor. Furthermore, ink sheet cassettes (each divided into a supply roll side) and a take-up side are stacked in a stocker arranged in the down-stream side of the forwarding direction of the ink sheet cassette with respect to the printing portion, and said take-up side of the ink sheet is taken out through the printing portion to spread the ink sheet by moving the stocker in the vertical direction as in said prior art (1).

(4) In the thermal transfer printing apparatus of said U.S. Pat. No. 5,030,969, the holding manner of the holding shaft for holding the ink sheet similar to that of said prior art (1) is improved so as to simplify in motion the mechanism for the reception and to circulate along a circle the ink sheet supply roll and the take-up roll of the ink sheet stock portion. As in the prior art (1), a predetermined printing is carried out by moving the take-up roll of the ink sheet of desired color, and the ink sheet take-up roll is returned in the sheet stock portion.

In the thermal transfer printing apparatus disclosed in the prior art (1), an ink sheet is selected by moving up and down the ink sheet stock portion including a plurality of ink sheets, so that a space for the movement of said ink sheet stock portion in the vertical direction is necessary, thereby causing the apparatus to be large. Further, the ink sheet of desired color is spread over the recording portion while holding the ink sheet and the holding portion of the ink sheet take-up roll, so that the driving power of the ink sheet selecting device becomes large, and an expensive high power driving source is required.

Furthermore, it is difficult to handle the ink sheet when the ink sheet is loaded on the ink sheet stock portion.

In the case of the prior art (2), a plurality of ink sheet cassettes each including an ink sheet are stored in the cassette holding unit arranged beside the recording portion composed of the thermal head and the platen roller, so that the take-up axis of the ink sheet is parallel to the recording portion. The ink sheet cassette is interchanged by moving the cassette parallel to the recording portion to reduce the space in the vertical direction. However, as the cassette holding unit is arranged beside the printing portion, a printing apparatus having a large printing width becomes large in width.

In the case of the prior art (3), a plurality of take-up rolls of the ink sheets stored in the drum are connected to the cassette plate rotatably supported by the drum shaft. Accordingly the mechanism becomes complicated and the loading of the ink sheet becomes difficult. Further, in the disclosed ink sheet cassette moving system, a plurality of ink sheet cassettes are fixed to the endless belt arranged over the printing portion, and the ink sheet cassette including the desired ink sheet therein is moved to the printing portion by driving the belt by the motor. Thus, the number of the ink sheet cassettes moved at the same time becomes large, and a high power driving source is required to drive the belt. Further, in the system wherein the ink sheet cassettes (each divided into the supply roll side) and the take-up side are stacked in the stocker arranged in the down stream side of the forwarding direction of the ink sheet with respect to the printing portion, the handling of the ink sheet is difficult as in the prior art (1), and the apparatus becomes large in size, because the ink sheet stock portion is moved up and down as in the prior art (1).

The invention disclosed in the prior art (4) is invented by the inventor of the invention disclosed in the prior art (1). In the prior art (4), such a defect in the prior art (1) that the high driving power for the ink sheet selecting mechanism is required is deleted. However, the other defects are not deleted.

SUMMARY OF THE INVENTION

An object of the present invention is to provide a thermal transfer printing apparatus which eliminates the above defects.

Another object of the present invention is to provide a thermal transfer printing apparatus which is inexpensive and small in size, in which the ink sheet can be handled easily, and in which a plurality of ink sheets can be interchanged with small power.

Yet another object of the present invention is to provide a thermal transfer printing apparatus comprising a thermal head including a plurality of heating elements, a platen roller to which said thermal head is urged selectively, a printing portion at which ink on an ink sheet is printed by a thermal energy produced when said heating elements are conducted on a recording paper inserted between said thermal head and said platen roller, a first stock portion for storing therein a first ink sheet, a second stock portion for storing therein a second ink sheet, and means for transferring to said printing portion selectively one of said first ink sheet and said second ink sheet to carry out the thermal transfer printing.

A further object of the present invention is to provide a thermal transfer printing apparatus comprising a thermal head including a plurality of heating elements, a platen roller to which said thermal head is urged selectively, a printing portion at which ink on an ink sheet is printed by a thermal energy produced when said heating elements are conducted on a recording paper inserted between said thermal head and said platen roller, a first stock portion for storing therein a first ink sheet cassette including a first ink sheet, a second stock portion for storing therein a second ink sheet cassette including a second ink sheet, and means for transferring to said printing portion selectively one of said first ink sheet cassette and said second ink sheet cassette to carry out the thermal transfer printing, said first and second ink sheet cassettes being arranged at the up-stream side and down-stream side of the ink sheet forwarding direction with respect to said printing portion, respectively.

The thermal transfer printing apparatus further comprises a first carrier for forwarding from said first stock portion said first ink sheet cassette to said printing portion, and for forwarding said first ink sheet cassette to said first stock portion to restore after the printing, and a second carrier for forwarding from said second stock portion said second ink sheet cassette to said printing portion, and for forwarding said second ink sheet to said second stock portion to restore after the printing, wherein said means is a driving source.

A still further object of the present invention is to provide a thermal head including a plurality of heating elements, a platen roller to which said thermal head is urged selectively, a printing portion at which ink on an ink sheet is printed by a thermal energy produced when said heating elements are conducted on a recording paper inserted between said thermal head and said platen roller, a first stock portion for storing therein a first ink sheet cassette including a first ink sheet with a supply and take-up cores thereof arranged substantially horizontally, a second stock portion for storing therein a second ink sheet cassette including a second ink sheet with a supply and take-up cores thereof arranged substantially horizontally, and means for transferring over said printing portion selectively one of said supply and take-up cores of said first and second ink sheets to carry out the thermal transfer printing, said first and second ink sheet cassettes being arranged at the up-stream side and down-stream side of the ink sheet forwarding direction with respect to said printing portion, respectively.

The thermal transfer printing apparatus further comprises a first carrier engaged with one of said cores around which said first ink sheet is wound for extending said first ink sheet over said printing portion, and for restoring said first ink sheet into said first stock portion after the printing, and a second carrier engaged with one of said cores around which said second ink sheet is wound for extending said second ink sheet over said printing portion, and for restoring said second ink sheet into said second stock portion after the printing, wherein said first and second carriers are driven selectively by a driving source.

A still further object of the present invention is to provide a a thermal head including a plurality of heating elements, a platen roller to which said thermal head is urged selectively, a printing portion at which ink on an ink sheet is printed by a thermal energy produced when said heating elements are conducted on a recording paper inserted between said thermal head and said platen roller, a first stock portion for storing therein a first ink sheet cassette including a first ink sheet with a supply and take-up cores thereof arranged substantially vertically, a second stock portion for storing therein a second ink sheet cassette including a second ink sheet with a supply and take-up cores thereof arranged substantially vertically, and means for transferring over said printing portion selectively one of said supply and take-up cores of said first and second ink sheets to carry out the thermal transfer printing, said first and second ink sheet cassettes being arranged at the up-stream side and down-stream side of the ink sheet forwarding direction with respect to said printing portion, respectively.

The thermal transfer printing apparatus further comprises a first carrier engaged with a core around which said first ink sheet is wound for extending said first ink sheet over said printing portion, and for restoring said first ink sheet into said first stock portion after the printing, and a second carrier engaged with a core around which said second ink sheet is wound for extending said second ink sheet over said printing portion, and for restoring said second ink sheet into said second stock portion after the printing, wherein said first and second carriers are driven selectively by a driving source.

A still further object of the present invention is to provide a thermal head including a plurality of heating elements, a platen roller to which said thermal head is urged selectively, a printing portion at which ink on an ink sheet is printed by a thermal energy produced when said heating elements are conducted on a recording paper inserted between said thermal head and said platen roller, a plurality of ink sheet cassettes arranged at either one of the up-stream side and down-stream side of the ink sheet forwarding direction with respect to said printing portion and stacked with one another, core holding means movable up and down and horizontally toward a position facing a core of said ink sheet according to a thermal transfer printing signal for a required ink sheet, and means for extending over said printing portion said ink sheet wound around said core to carry out the thermal transfer printing by removing said core from the corresponding ink sheet cassette and for restoring said core into said ink sheet cassette after printing.

The above and other objects as well as advantageous features of the invention will become apparent from a consideration of the following description of the preferred embodiments taken in conjunction with the appended claims, and the accompanying drawings.

DESCRIPTION OF THE PREFERRED EMBODIMENTS

An embodiment of the present invention will be explained with reference to FIGS. 1–11.

Figure 1:
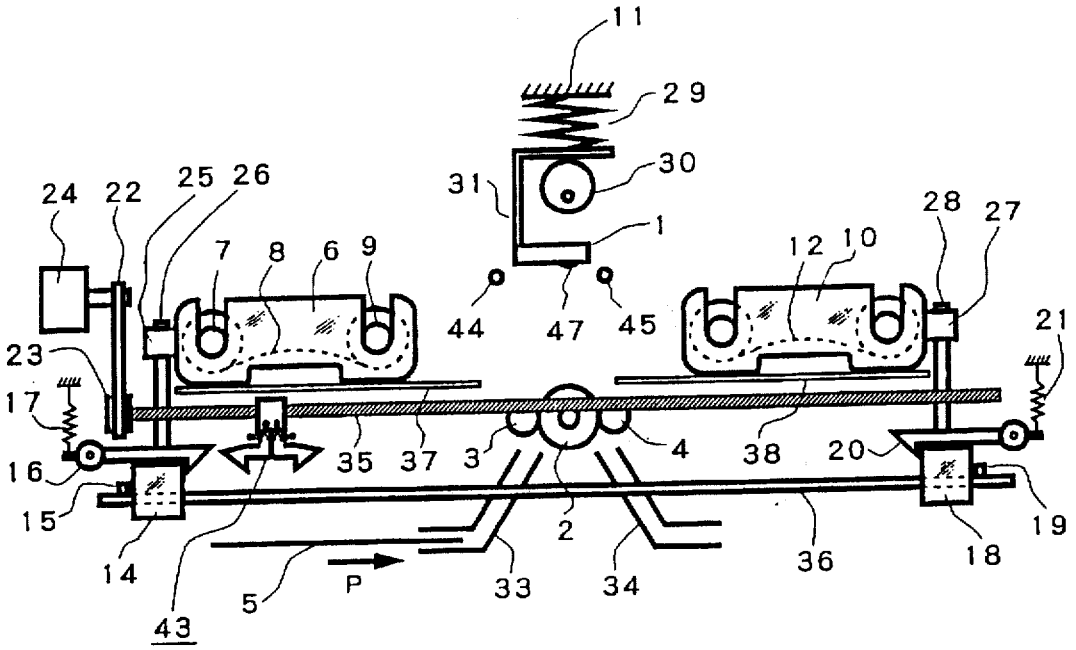
FIG. 1 is a schematic view of a thermal transfer printing apparatus of the present invention.
Figure 11:
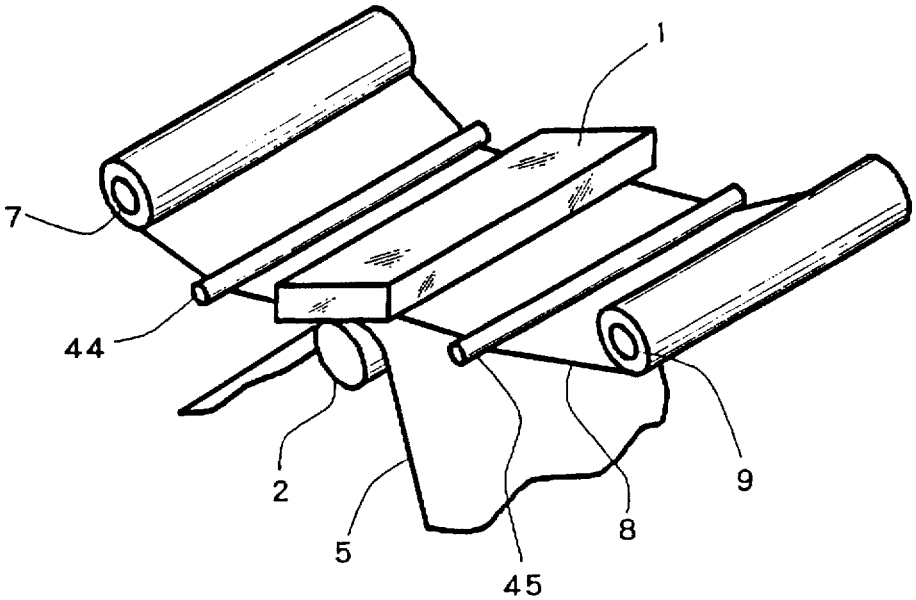
FIG. 11 is a schematic perspective view of the basic construction of the thermal transfer printing apparatus.

FIG. 11 is a schematic perspective view of the basic construction of the thermal transfer printing apparatus. As shown in FIG. 1, a recording paper 5 and an ink sheet 8 are passed between a thermal head 1 having a plurality of linear heating elements extending along the printing area of the head and a platen roller 2 rotatable in the clockwise direction and the counter-clockwise direction according to a predetermined sequence so that the ink layer of the ink sheet 8 faces the recording paper 5. The wrinkles of the ink sheet 8 are pressed out by tension bars 44 and 45. Ink on the ink sheet 8 is printed on the recording paper 5 by a heat energy generated by conducting the heating elements selectively, while rotating the platen roller 2 in the recording paper transfer direction and pressing the thermal head 1 against the platen roller 2 according to the command from a control portion (not shown).

Figure 9:
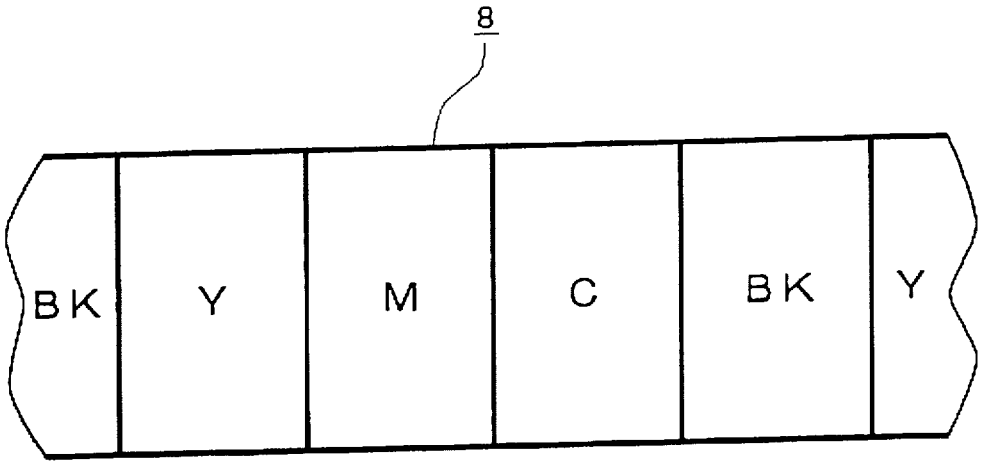
FIG. 9 is a view of a multiple-color ink sheet for use in the thermal transfer printing apparatus.

The ink sheet 8 for use in the thermal transfer printing has ink portions of yellow y, magenta M, Cyan C and black BK arranged side by side, as shown in FIG. 9. A color printing can be obtained by superposing inks of different colors by moving the recording paper 5 reciprocally. There are two kinds of ink layers of the ink sheet 8. One is for the fusion type thermal transfer printing of which running cost is low because plain paper can be used, but the image quality is not so good. The other is for the sublimation type thermal transfer printing of which running cost is high because special recording paper is required, but the image quality is good.

Accordingly, in consideration of the running cost, test printing is carried out by using an ink sheet for the fusion type thermal transfer printing and the plain paper, and the final finishing printing is carried out by one thermal transfer printing apparatus by using an ink sheet for the sublimation type thermal transfer printing and the special paper. Further, an ink sheet of mono-color, for precoat, postcoat or the like other than the multiple-color ribbon shown in FIG. 9 can be used. If the combination of these ink sheets are used in one thermal transfer printing apparatus such merits that the cost of the ink sheets is reduced can be obtained, and the profit of the thermal transfer printing apparatus using a plurality of ink sheets can be made.

As shown in FIG. 1, the thermal head 1 having linear heating elements 47 arranged in the entire printing area is fixed on a head supporting arm 31, and a portion of said head supporting arm 31 is urged by an end of a head spring 29 against a head cam 30 supported eccentrically. Accordingly, the thermal head 1 is moved up and down by rotating said cam 30. Further, the other end of the head spring 29 is supported by a head supporting member 11 which can be moved up and down independently, so that a large space can be formed under the thermal head 1 by combining the movement of the head supporting member 11 with the movement of the thermal head 1 due to the rotation of the cam 30.

Figure 10:
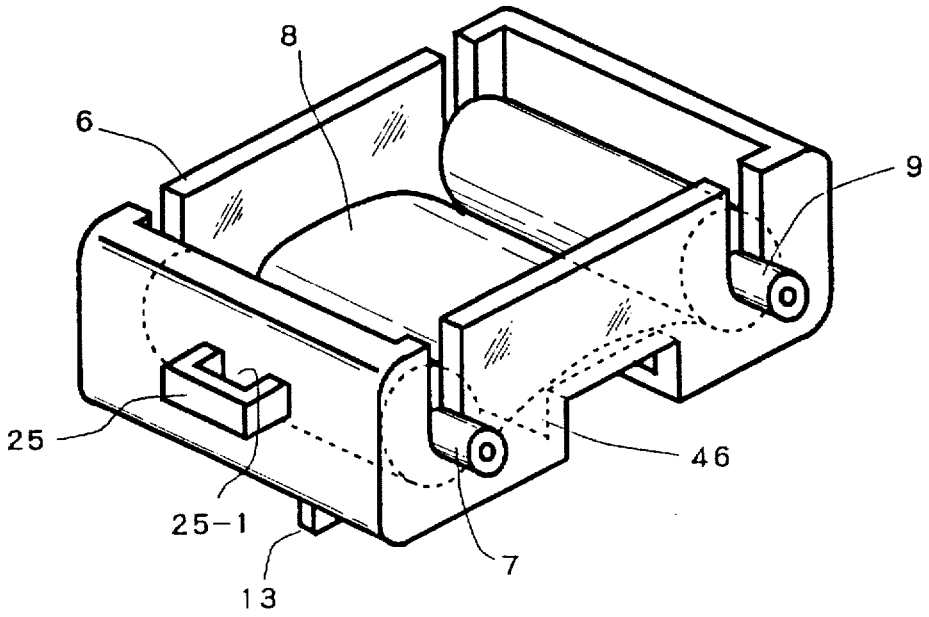
FIG. 10 is a perspective view of an ink sheet cassette for use in the thermal transfer printing apparatus.

A first ink sheet cassette 6 for storing therein the ink sheet 8 is shown in FIG. 10. One end of the ink sheet 8 is wound around a supply side core 7, and the other end is wound around a take-up side core 9. One end of each of said cores 7 and 9 is projected from the first ink sheet cassette 6 and connected to an ink sheet transfer mechanism (not shown) of the printing apparatus. When the ink sheet 8 stored in the first ink sheet cassette 6 is to be interchanged, the first ink sheet cassette 6 is taken out of the printing apparatus, so that the interchanging operation can be carried out easily without touching the human hand with the ink sheet 8. A handle 25 is provided on one outer side of the first ink sheet cassette 6. A through hole 25-1 for a finger 26 of a first carriage 14 is formed in said handle 25. A window 46 through which the ink sheet 8 is moved toward the printing portion is formed on the bottom portion of the first ink sheet cassette 6 as shown in FIG. 10. Further, a small guide projection 13 for guiding linearly the first ink sheet cassette 6 in connection with a guide groove formed on a first cassette guide plate 37 is provided on said bottom portion as shown in FIG. 10. A second ink sheet cassette 10 which is similar in construction to said first ink sheet cassette 6 is provided.

As shown in FIG. 1, a first stock portion is provided. In said first stock portion, the handle 25 of the first ink sheet cassette 6 including the 10 ink sheet 8 is engaged with the finger 26 of the first carrier 14 arranged at the up-stream side of the cassette forwarding direction shown by an arrow P with respect to the printing portion which is composed of the thermal head 1 and the platen roller 2. A second stock portion is formed. In said second stock portion, a handle 27 of a second ink sheet cassette 10 including an ink sheet 12 is engaged with a finger 28 of a second carrier 18 arranged at the down-stream side of the cassette forwarding direction with respect to the printing portion. The first carrier 14 and the second carrier 18 can be moved along a guide shaft 36 and held between stoppers 15 and 19 and arms 16 and 20, respectively, when the printing apparatus is not operated, and are positioned and waited at the first and second stock portions as shown in FIG. 1, respectively.

A carriage 43 of an ink sheet cassette selecting mechanism is moved by a lead screw 35. The lead screw 35 is rotated by a carriage motor 24, a timing belt 22 and a timing pully 23 with teeth fixed on one end of said lead screw 35. When the lead screw 35 is rotated, the carriage 43 is moved linearly according to the rotary direction of the lead screw 35 between the first carrier 14 and the second carrier 18.

The details of engagement between the first carrier 14 at the first stock portion, the second carrier 18 at the second stock portion, and the carriage 43 will be explained with reference to FIGS. 2–8.

Figure 2:
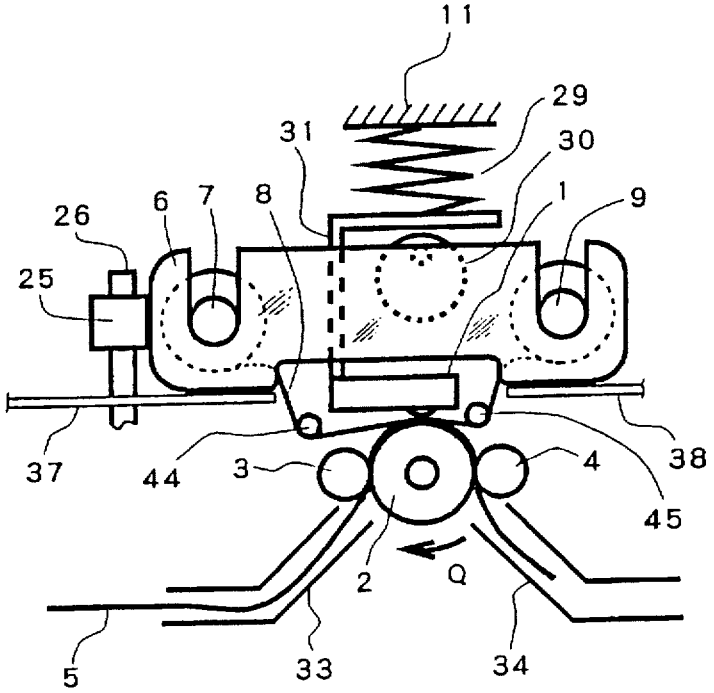
FIG. 2 is a schematic view of the thermal transfer printing apparatus of FIG. 1.
Figure 6:
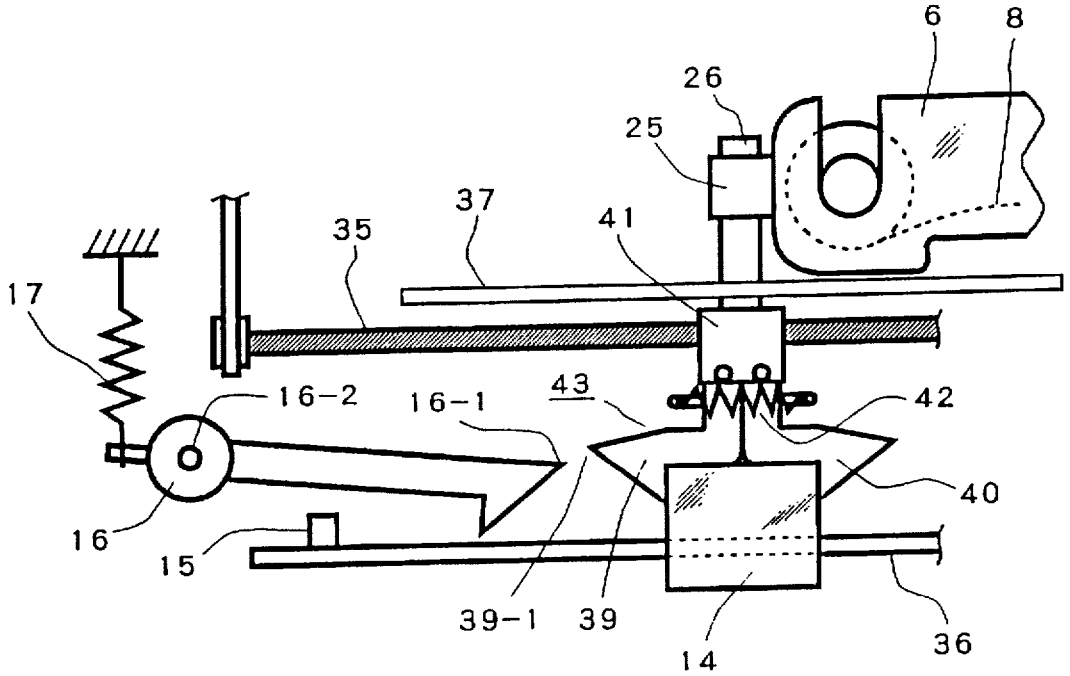
FIG. 6 is a schematic view of the thermal transfer printing apparatus of FIG. 1.

FIG. 2 shows the actual printing state by using the desired ink sheet with the printing portion. In case that the printing is executed by using the first ink sheet cassette 6 including the ink sheet 8, for example, the thermal head 1 is lifted so as to be able to pass the first ink sheet cassette 6 between the thermal head 1 and the platen roller 2 at first, the first ink sheet cassette 6 is moved on the platen roller 2 by the movement of the first carrier 14 held by the carriage 43 as shown in FIG. 6, and then the thermal head 1 is lowered. The tension bars 44 and 45 mounted as a unit on the head supporting arm 31 are moved down at the same time of the down movement of the thermal head 1 so as to apply a tension to the ink sheet 8 in order to press out the wrinkles of the ink sheet 8. In case that the ink sheet 8 is formed of four color portions of yellow Y, Magenta M, Cyan C and Black BK each of which corresponds to one page as shown in FIG. 9, the ink sheet 8 is positioned so that the leading end of the portion of yellow Y is arranged on the platen roller 2. When the thermal head 1 is lowered, it is stopped temporarily at a position where a small gap is formed between the ink sheet 8 and the platen roller 2. The recording paper 5 is passed through a transfer path 33 at the up-stream side and inserted between the platen roller 2 and a pinch roller 3. The recording paper 5 is then passed through a gap formed between the ink sheet 8 and the platen roller 2, inserted between the platen roller 2 and a pinch roller 4, and moved through a transfer path 34 at the down-stream side, and vice versa.

When the leading end of the recording paper 5 reaches the printing start position, the thermal head 1 is lowered further and pressed with a predetermined pressure by the lead spring 29 against the platen roller 2 so as to hold the ink sheet 8 and the recording paper 5 between the thermal head 1 and the platen roller 2. This is the print starting state. The thermal transfer printing to the recording paper is carried out successively when the heating elements 47 corresponding to the desired image data are conducted while rotating the take-up side core 9 by the winding motor (not shown) and rotating the platen roller 2 in a direction of Q. After the printing of one page has been completed, the thermal head 1 is elevated a little, the recording paper 5 is returned to the original print starting position, and then the ink sheet 8 is fed so that the leading end of the next color, that is, magenta M is positioned on the platen roller 2. After that, the thermal head 1 is pressed again and repeated the printing for every colors. After the entire printing has been finished, the thermal head 1 is elevated to the top position. Then, the carriage motor 24 is rotated, and the first carrier 14 is moved toward the first stock portion by the rotation of the lead screw 35 to restore the first ink sheet cassette 6.

Figure 3:
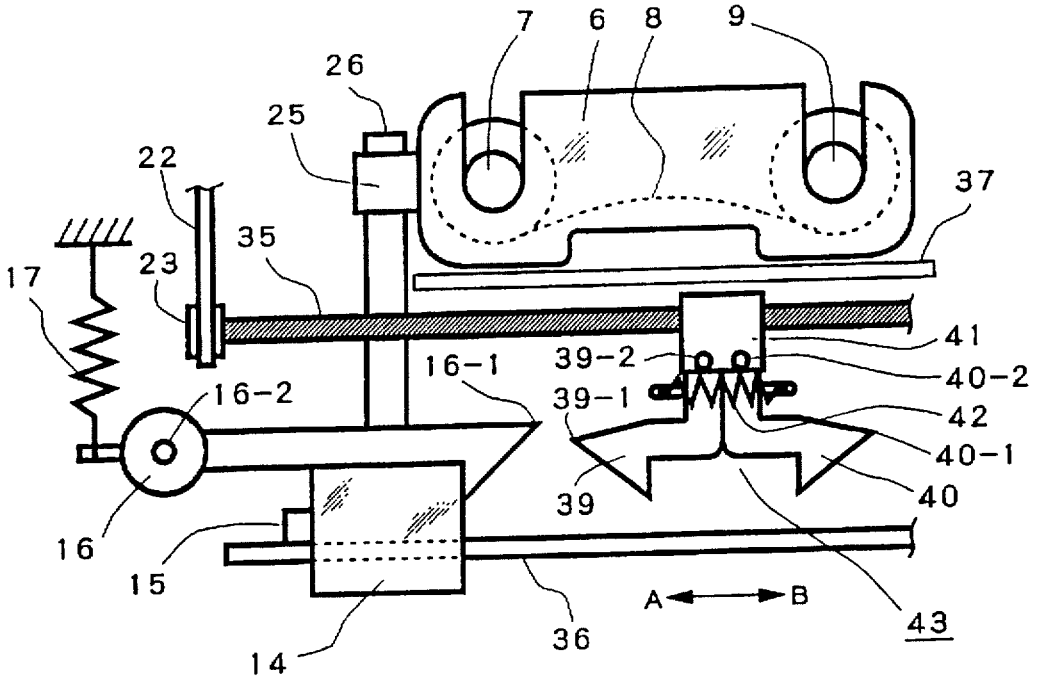
FIG. 3 is a schematic view of the thermal transfer printing apparatus of FIG. 1.

Next, the ink sheet cassette interchanging operations will be explained in detail hereunder. FIG. 3 shows detailedly the relation a position of the first ink sheet cassette 6, the first carrier 14, an arm 16, an arm spring 17 and the carriage 43 at the first stock portion. The carriage 43 is moved linearly by the rotation of the lead screw 35 The carriage 43 has a moving block 41, a moving arm 39 of first stock portion side, and a moving arm 40 of second stock portion side. The moving arms 39 and 40 are pivoted about fulcrums 39-2 and 40-2, respectively. The first carrier 14 is moved along the guide shaft 36, but is held between the stopper 15 and the arm 16 urged and rotated centering around a fulcrum 16-2 by the arm spring 17 when the first carrier 14 is not selected. In this state, as shown in FIG. 3, a tip end 39-1 of the moving arm 39 is positioned a little lower than a tip end 16-1 of the arm 16.

Figure 4:
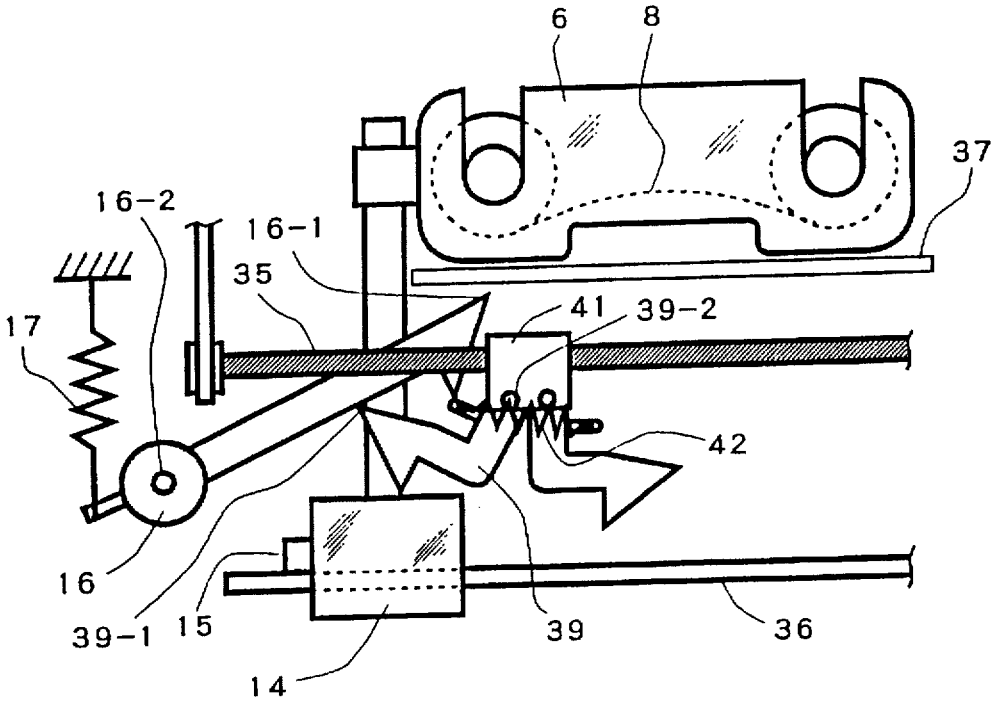
FIG. 4 is a schematic view of the thermal transfer printing apparatus of FIG. 1.
Figure 5:
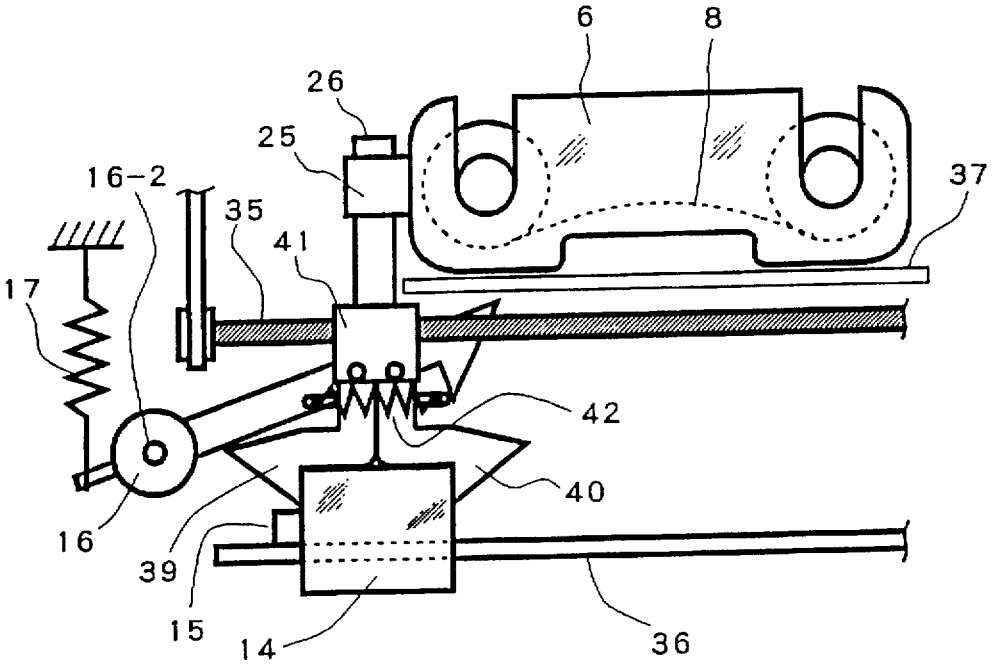
FIG. 5 is a schematic view of the thermal transfer printing apparatus of FIG. 1.

Accordingly, when the carriage 43 is moved in the direction of arrow A from the state shown in FIG. 3, the tip end 39-1 is brought into engagement with the lower surface of the tip end 16-1 of the arm 16, and as a result the tip end 16-1 is moved up to release the first carrier 14 as shown in FIG. 4. When the carriage 43 is moved further in the direction of arrow A, the moving arm 39 engages with the left side of the first carrier 14 and then the moving arm 40 engages with the right side of the first carrier 14, so that the first carrier 14 is held by the moving arms 39 and 40 as shown in FIG. 5. In this state, when the lead screw 35 is rotated reversely, the first carrier 14 engaged with the first ink sheet cassette 6 is separated from the first stock portion to transfer the first ink sheet cassette 6 to the printing portion.

Figure 7:
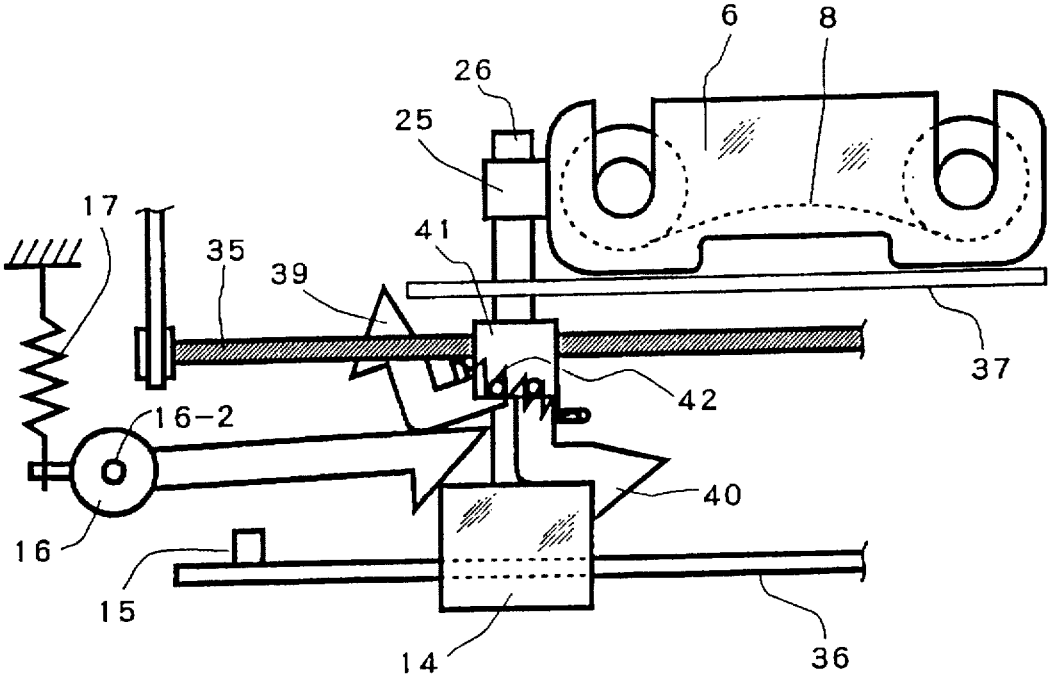
FIG. 7 is a schematic view of the thermal transfer printing apparatus of FIG. 1.
Figure 8:
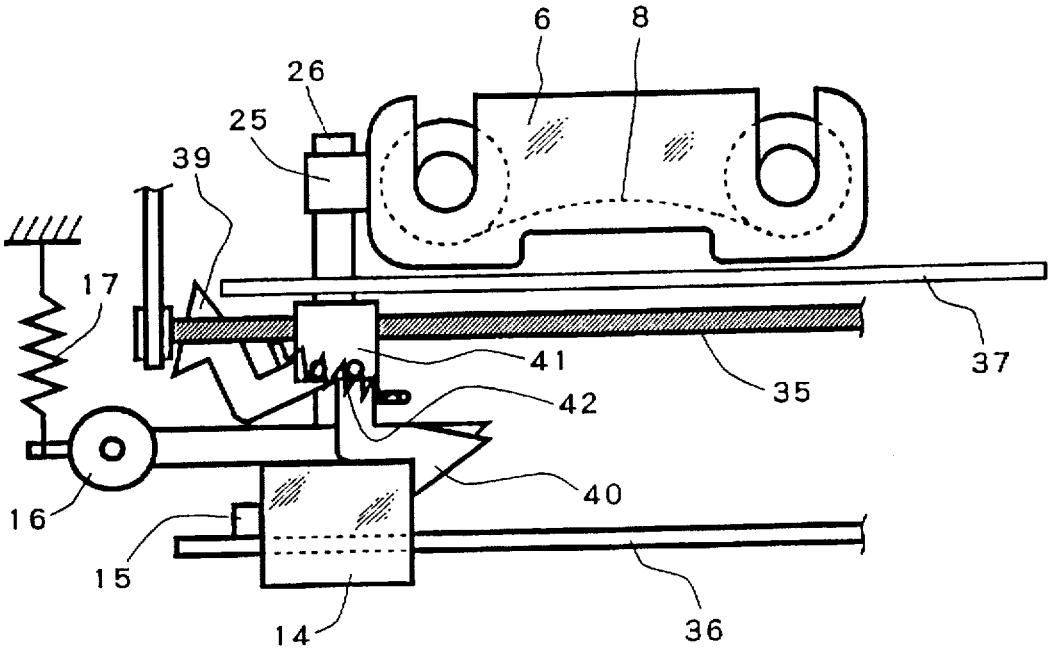
FIG. 8 is a schematic view of the thermal transfer printing apparatus of FIG. 1.

The first ink sheet cassette 6 is returned to the first stock portion after the predetermined printing operation at the printing portion has been completed, as explained hereunder. In a state shown in FIG. 6, the first carrier 14 is held by the moving arms 39 and 40 of the carriage 43 and separated from the first stock portion, and the tip end 16-1 of the arm 16 is lower than the tip end 39-1 of the arm 39. In this state, when the carriage 43 is moved in the direction of arrow A, the tip end 16-1 of the arm 16 is brought into engagement with the lower surface of the tip end 39-1 of the arm 39, and as a result the arm 39 is moved up as shown in FIG. 7. When the carriage 43 is moved further in the direction of arrow A, the carriage 14 is held between the stopper 15 and the tip end 16-1 of the arm 16 in the first stock portion as shown in FIG. 8. In this state, when the lead screw 35 is rotated reversely, only the carriage 43 is moved in the direction of arrow B and the ink sheet cassette 6 is returned in the first stock portion as shown in FIG. 3.

Similarly to the taking out and returning of the first ink sheet cassette 6 shown in FIGS. 1–8, the taking out and returning storing of the second ink sheet cassette 10 are carried out by moving the carriage 43 in the direction of arrow B by the rotation of the lead screw 35 and by engaging the moving arm 40 of the carriage 43 with an arm 20 at the second stock portion. Thus, both the fusion type and sublimation type thermal transfer printings can be used, and many modes of the thermal transfer printings can be executed by using the combination of the first ink sheet cassette 6 including the first ink sheet 8 and the second ink sheet cassette 10 including the second ink sheet 12.

As stated above, according to the above-mentioned embodiment of the present invention, the thermal transfer printing apparatus comprises the thermal head including a plurality of heating elements, the platen roller to which said thermal head is urged selectively, the printing portion at which ink on the ink sheet is printed by the thermal energy produced when said heating elements are conducted on the recording paper inserted between said thermal head and said platen roller, the first stock portion for storing therein the first ink sheet cassette including the first ink sheet, the second stock portion for storing therein the second ink sheet cassette including the second ink sheet, means for selecting one of said first ink sheet cassette and said second ink sheet cassette to carry out the thermal transfer printing, the first carrier for engaging with the first ink sheet cassette at the first stock portion and transferring it to the printing portion, and restoring it in the first stock portion after the printing, and the second carrier for engaging with the second ink sheet cassette at the second stock portion and transferring it to the printing portion, and returning it in the second stock portion after the printing, and the driving device for driving said first and second carriers. Accordingly, a thermal transfer printing apparatus inexpensive and small in size can be obtained. In this apparatus, the ink sheet can be handled easily and a plurality of ink sheets can be interchanged with small power.

Another embodiment of the present invention will be explained with reference to FIGS. 12–20. Parts of the apparatus which are similar to corresponding parts of the apparatus of said embodiment have been given corresponding reference numerals and need not be further redescribed.

Figure 12:
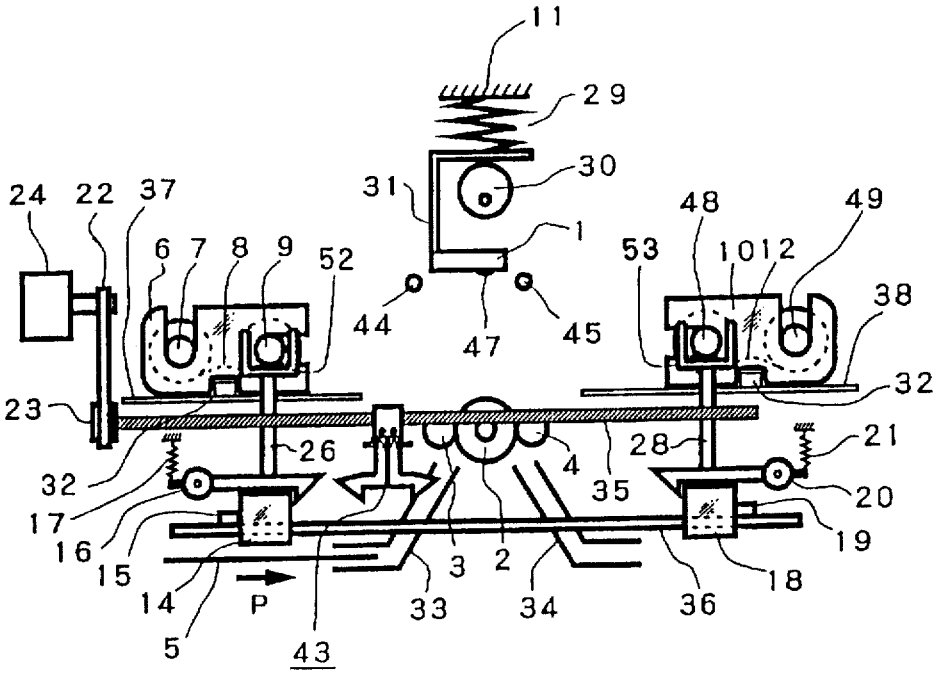
FIG. 12 is a schematic view of a thermal transfer printing apparatus of another embodiment of the present invention.
Figure 13:
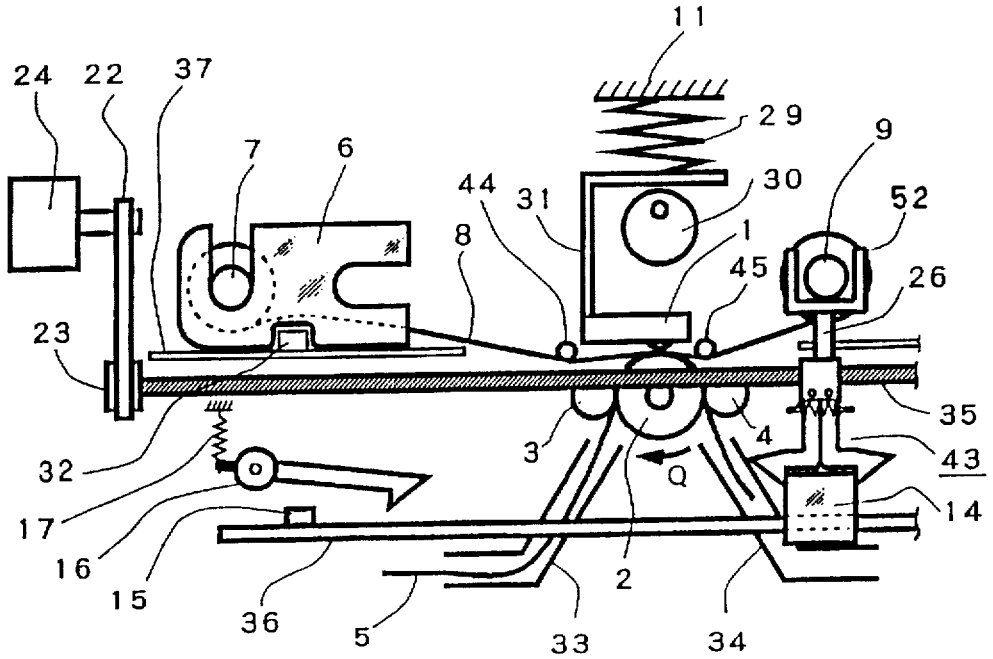
FIG. 13 is a schematic view of the thermal transfer printing apparatus of FIG. 12.

As shown in FIG. 12, the first ink sheet cassette 6 is mounted on the cassette supporting plate 37 at the first stock portion so that the supply side core 7 and the take-up side core 9 of the ink sheet 8 are arranged horizontally substantially.

Figure 20:
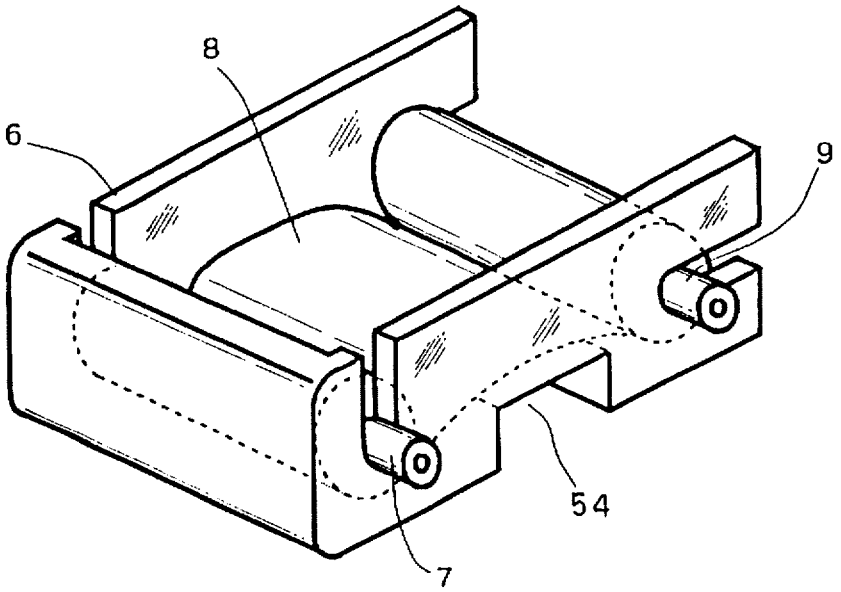
FIG. 20 is a perspective view of an ink sheet cassette for use in the thermal transfer printing apparatus of FIG. 12.

A positioning groove 54 of the first ink sheet cassette 6 shown in FIG. 20 is fitted with a cassette positioning boss 32 formed on the cassette supporting plate 37 so that the first ink sheet cassette 6 is stored. In this state, the take-up side core 9 of the ink sheet 8 is held by a finger 52 of the carrier arm 26 fixed on the first carrier 14 arranged at the up-stream side of the ink sheet forwarding direction P with respect to the printing portion formed of the thermal head 1 and the platen roller 2.

Similarly, a take-up side core 48 of the second ink sheet cassette 10 mounted on a cassette supporting plate 38 at the second stock portion is held by a finger 53 of the carrier arm 28 fixed on the second carrier 18 arranged at the down-stream side of the ink sheet forwarding direction P with respect to the printing portion formed of the thermal head 1 and the platen roller 2.

Further, the details of engagements of the first carrier 14 at the first stock portion, the second carrier 18 at the second stock portion, and the carriage 43 will be explained with references to FIGS. 13–19.

Figure 18:
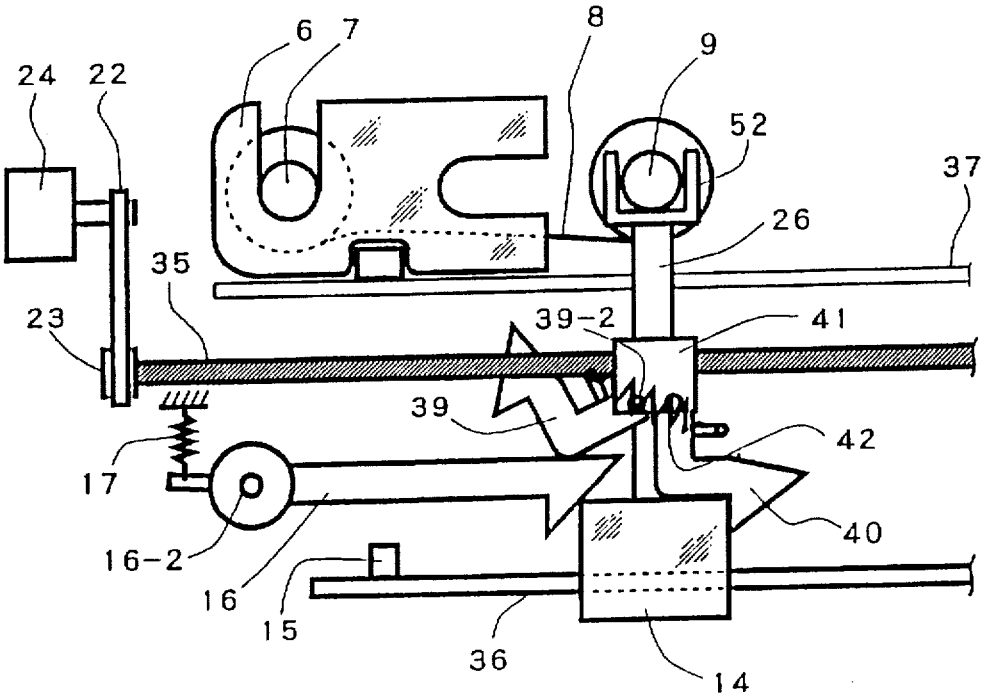
FIG. 18 is a schematic view of the thermal transfer printing apparatus of FIG. 12.

FIG. 18 shows the actual printing state by using the desired ink sheet with the printing portion and the first stock portion. In case that the printing is executed by using the ink sheet 8, for example, the thermal head 1 is lifted so as to be able to pass the roll of ink sheet 8 wound around the take-up side core 9 between the thermal head 1 and the platen roller 2 at first, then the core 9 of the ink sheet 8 is moved over the platen roller 2 to a predetermined position by the movement of the first carrier 14 held by the carriage 43. At this time, the power of a take-up motor (not shown) is transmitted to the end of the take-up side core 9 through an ink sheet forwarding mechanism (not shown).

In this embodiment, after the entire printing, has been finished, the thermal head 1 is elevated to the top position. Then, the carriage motor 24 is rotated, and the first carrier 14 held by the carriage 43 is moved toward the first stock portion by the rotation of the lead screw 35 to return the take-up core 9 of the ink sheet 8 into the first ink sheet cassette 6. At this stage, when the supply side core 7 is rotated in the reverse direction by the supply motor (not shown) the looseness of the ink sheet 8 is absorbed.

Next, the ink sheet interchanging operations will be explained in detail with reference to FIGS. 14–19.

Figure 14:
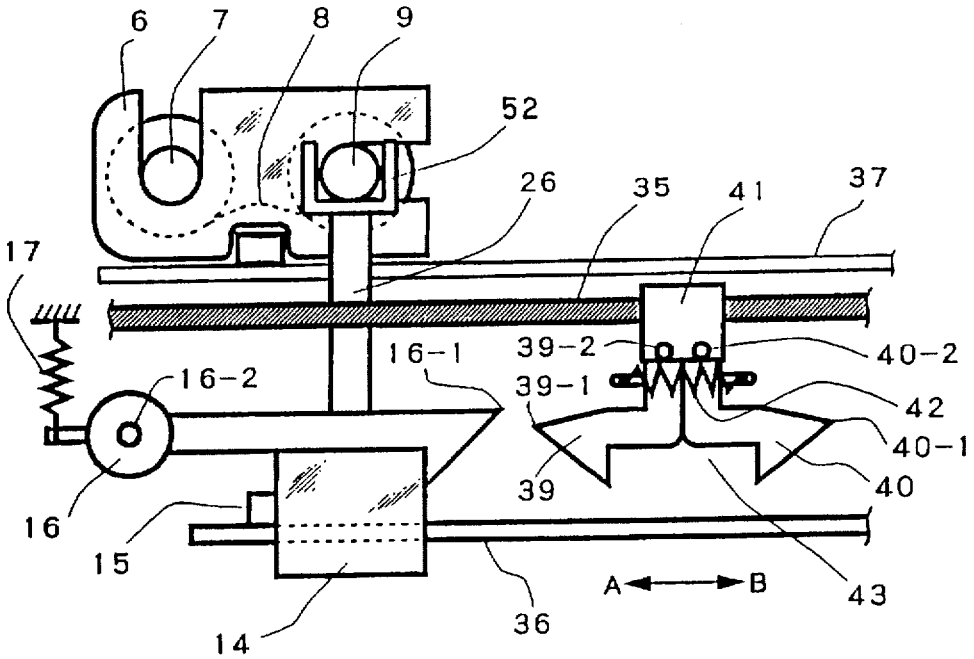
FIG. 14 is a schematic view of the thermal transfer printing apparatus of FIG. 12.
Figure 15:
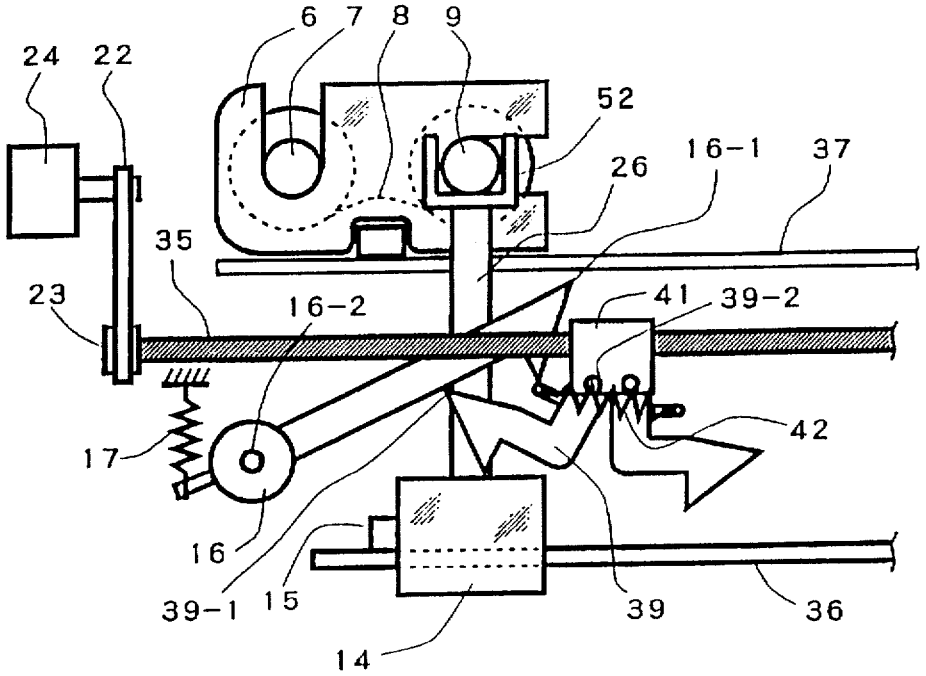
FIG. 15 is a schematic view of the thermal transfer printing apparatus of FIG. 12.
Figure 16:
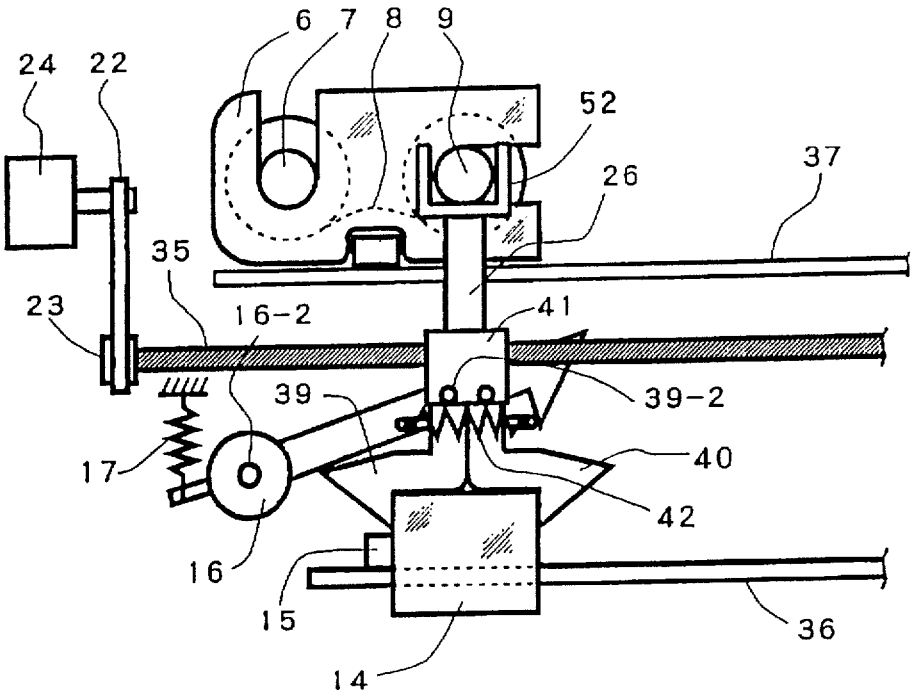
FIG. 16 is a schematic view of the thermal transfer printing apparatus of FIG. 12.
Figure 17:
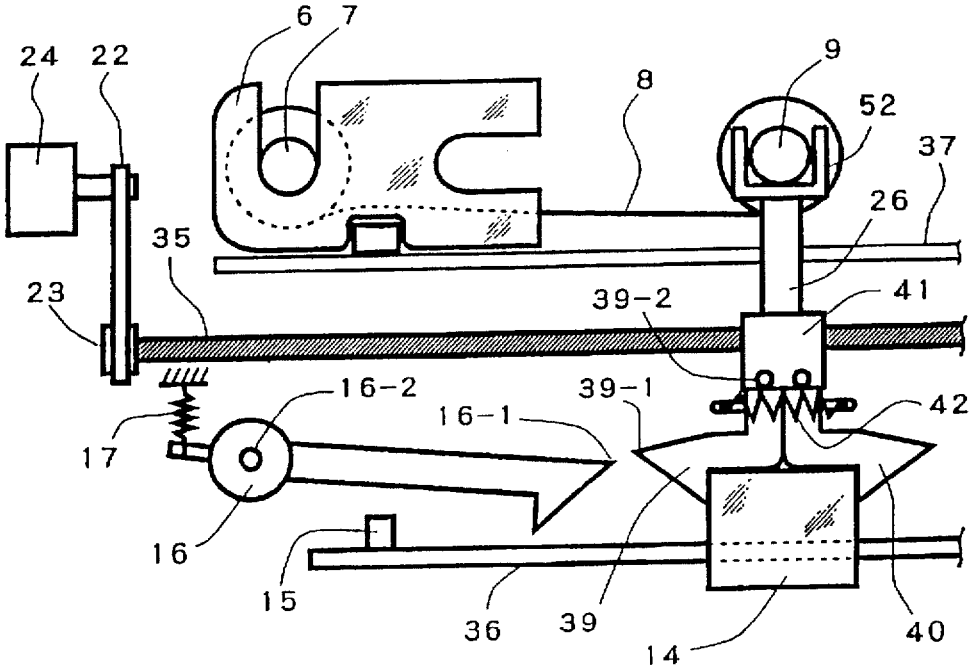
FIG. 17 is a schematic view of the thermal transfer printing apparatus of FIG. 12.

When the carriage 43 is moved in the direction of arrow A from the state shown in FIG. 14, the tip end 39-1 is brought into engagement with the lower surface of the tip end 16-1 of the arm 16, and as a result the tip end 16-1 is moved up to release the first carrier 14 as shown in FIG. 15. When the carriage 43 is moved further in the direction of arrow A, the moving arm 39 engages with the left side of the first carrier 14 and then the moving arm 40 engages with the right side of the first carrier 14, so that the first carrier 14 is held by the moving arms 39 and 40 as shown in FIG. 16. In this state, when the lead screw 35 is rotated reversely, the first carrier 14 which holds the take-up side core 9 of the first ink sheet 8 is separated from the first stock portion to transfer the first ink sheet 8 to a predetermined position beyond the printing portion so as to extend the ink sheet 8 over the printing portion.

Figure 19:
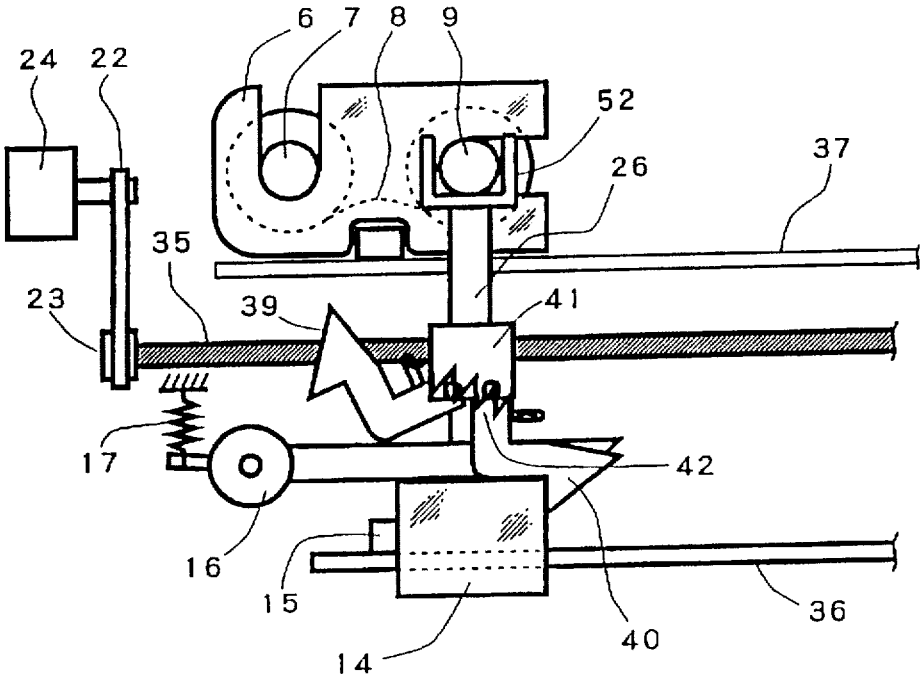
FIG. 19 is a schematic view of the thermal transfer printing apparatus of FIG. 12.

The take-up side core 9 of the first ink sheet is returned to the first stock portion after the predetermined printing operation at the printing portion has been completed, as explained hereunder. In a state in FIG. 17, the first carrier 14 is held by the moving arms 39 and 40 of the carriage 43 and separated from the first stock portion, and the tip end 16-1 of the arm 16 is lower than the tip end 39-1 of the arm 39. In this state, when the carriage 43 is moved in the direction of arrow A, the tip end 16-1 of the arm 16 is brought into engagement with the lower surface of the tip end 39-1 of the arm 39, and as a result the arm 39 is moved up as shown in FIG. 18. When the carriage 43 is moved further in the direction of arrow A, the carriage 14 is held between the stopper 15 and the tip 16-1 of the arm 16 in the first stock portion and the take-up side core 9 is stored into the ink sheet cassette 6 as shown in FIG. 19. In this movement, the looseness of the ink sheet is absorbed by the operation described above. In this state, when the lead screw 35 is rotated reversely, only the carriage 43 is moved in the direction of arrow B as shown in FIG. 14.

Similarly to the taking out and returning of the take-up side core 9 of the first ink sheet 8 shown in FIGS. 12–19, the taking out and returning of the take-up side core 48 of the second ink sheet 12 are carried out by moving the carriage 43 in the direction of arrow B by the rotation of the lead screw 35 and by engaging the moving arm 40 of the carriage 43 with the arm 20 at the second stock portion. Thus, both the fusion type and sublimation type thermal transfer printings can be used, and many modes of the thermal transfer printings can be executed by using the combination of the first ink sheet cassette 6 including the first ink sheet 8 and the second ink sheet cassette 10 including the second ink sheet 12.

As stated above, according to the above-mentioned embodiment of the present invention, the thermal transfer printing apparatus comprises the thermal head including a plurality of heating elements, the platen roller to which said thermal head is urged selectively, the printing portion at which ink on the ink sheet is printed by the thermal energy produced when said heating elements are conducted on the recording paper inserted between said thermal head and said platen roller, the first stock portion for storing therein the first ink sheet cassette including the supply and the take-up side cores of the first ink sheet substantially horizontally, the second stock portion for storing therein the second ink sheet cassette including supply and the take-up side cores of the second ink sheet substantially horizontally, means for selecting one of the take-up side cores of said first ink sheet and said second ink sheet to carry out the thermal transfer printing, the first carrier for engaging with the core of the first ink sheet at the first stock portion and extending the first ink sheet over the printing portion, and returning it in the first stock portion after the printing, and the second carrier for engaging with the core of the second ink sheet cassette at the second stock portion and extending the second ink sheet over the printing portion, and restoring it in the second stock portion after the printing, and the driving device for driving side first and second carriers. Accordingly, a thermal transfer printing apparatus inexpensive and small in size can be obtained. In this apparatus, the ink sheet can be handled easily and a plurality of ink sheets can be interchanged with small power. Further, according to the above embodiment of the present invention, the ink sheet cassette can be made small, because it is not necessary to penetrate the ink sheet cassette so that a distance between the supply side core and the take-up side core of the ink sheet can be reduced in the extent that both cores are not interfered with each other.

Another embodiment of the present invention will be explained with reference to FIGS. 21–29. Parts of the apparatus which are similar to corresponding parts of the apparatus of said embodiment have been given corresponding reference numerals and need not be further redescribed.

Figure 21:
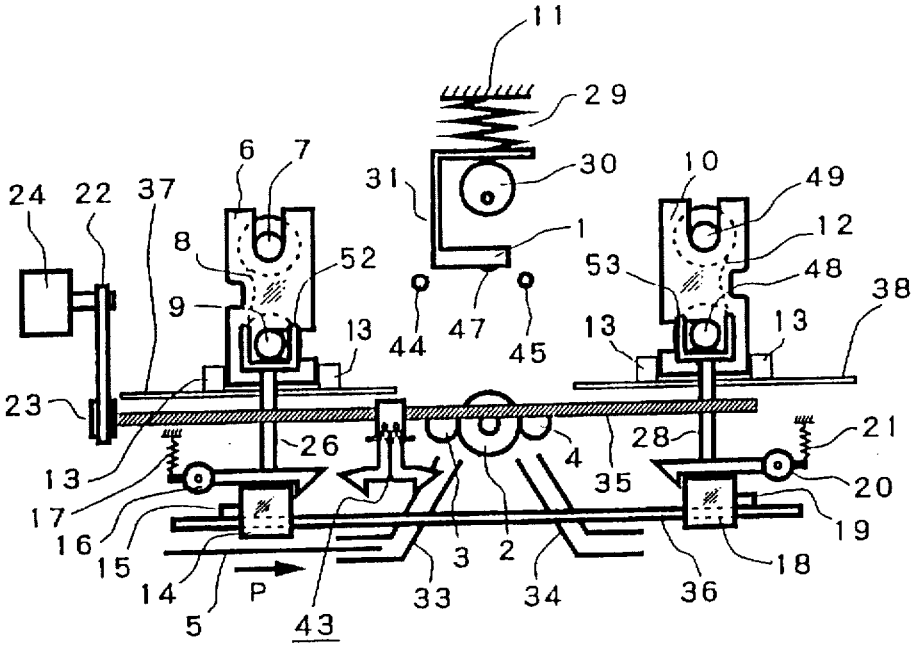
FIG. 21 is a schematic view of a thermal transfer printing apparatus according to another embodiment of the present invention.

As shown in FIG. 21, the first ink sheet cassette 6 is mounted on the cassette supporting plate 37 at the first stock portion so that the supply side core 7 and the take-up side core 9 of the ink sheet 8 are arranged normal substantially to the plane of said cassette supporting plate 37. The bottom portion of the first ink sheet cassette 6 is fitted with a cassette positioning boss 13, 13 formed on the cassette supporting plate 37 so that the first ink sheet cassette 6 is stored. In this state, the take-up side core 9 of the ink sheet 8 is held by the finger 52 of the carrier arm 26 fixed on the first carrier 14 arranged at the up-stream side of the ink sheet forwarding direction P with respect to the printing portion formed of the thermal head 1 and the platen roller 2.

Similarly, the take-up side core 48 of the second ink sheet cassette 10 mounted on the cassette supporting plate 38 at the second stock portion is held by the finger 53 of the carrier arm 28 fixed on the second carrier 18 arranged at the down-stream side of the ink sheet forwarding direction P with respect to the printing portion formed of the thermal head 1 and the platen roller 2.

Further, the details of engagements of the first carrier 14 at the first stock portion, the second carrier 18 at the second stock portion, and the carriage 43 will be explained with references to FIGS. 22–28.

Figure 22:
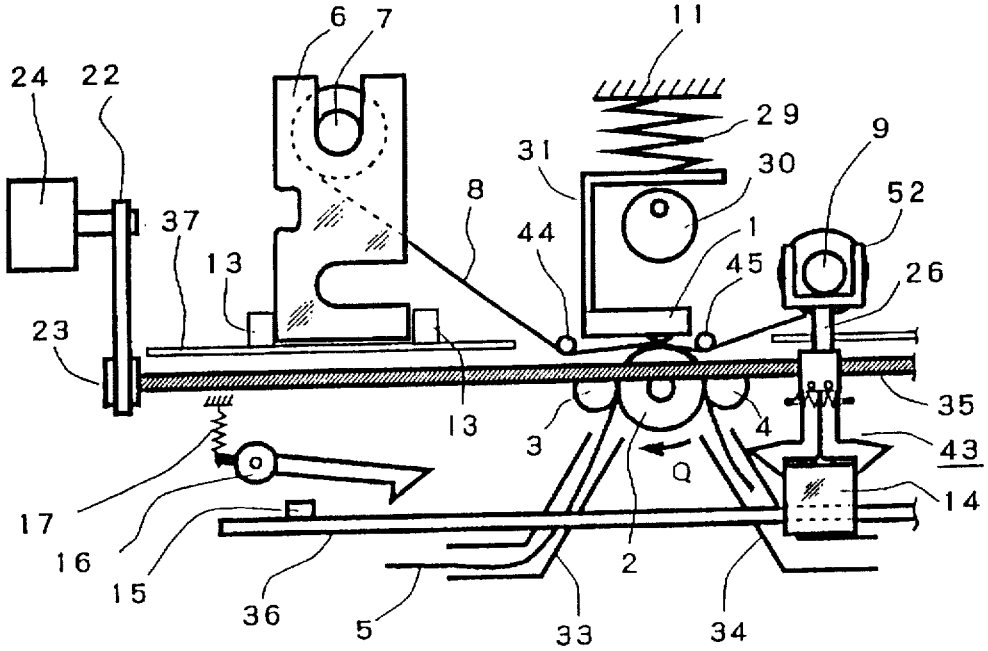
FIG. 22 is a schematic view of the thermal transfer printing apparatus of FIG. 21.

FIG. 22 shows the actual printing state by using the desired ink sheet with the printing portion and the first stock portion. In case that the printing is executed by using the ink sheet 8, for example, the thermal head 1 is lifted so as to be able to pass the roll of ink sheet 8 wound around the take-up side core 9 between the thermal head 1 and the platen roller 2 at first, then the core 9 of the ink sheet 8 is moved over the platen roller 2 to a predetermined position by the movement of the first carrier 14 held by the carriage 43. Next, the ink sheet interchanging operations will be explained in detail with reference to FIGS. 23–28.

Figure 23:
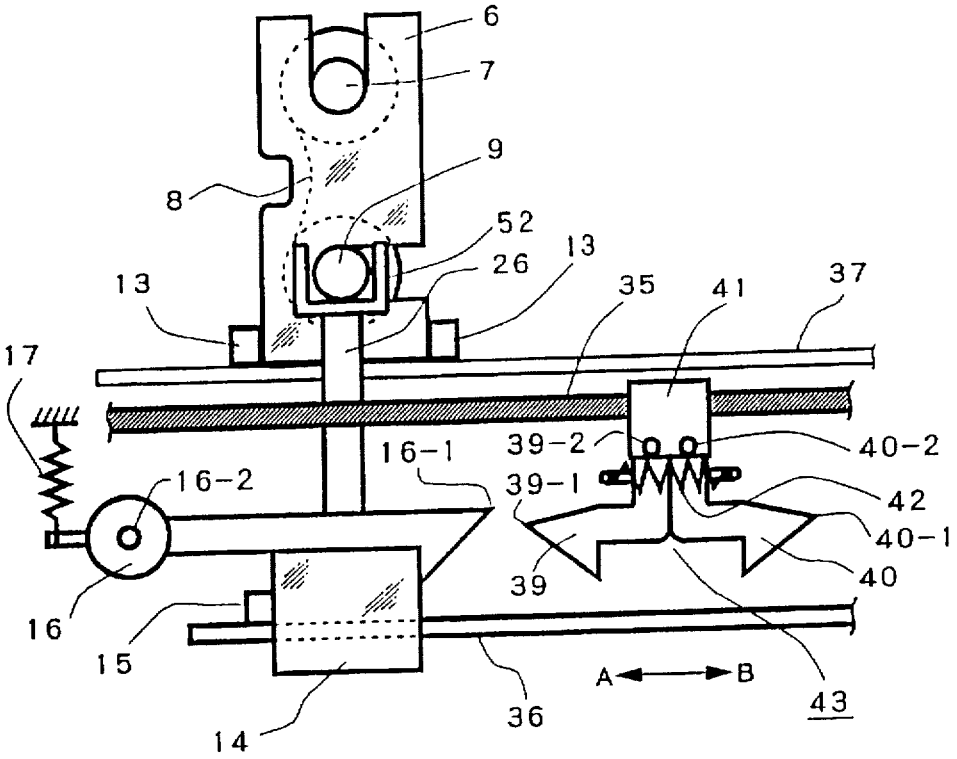
FIG. 23 is a schematic view of the thermal transfer printing apparatus of FIG. 21.
Figure 24:
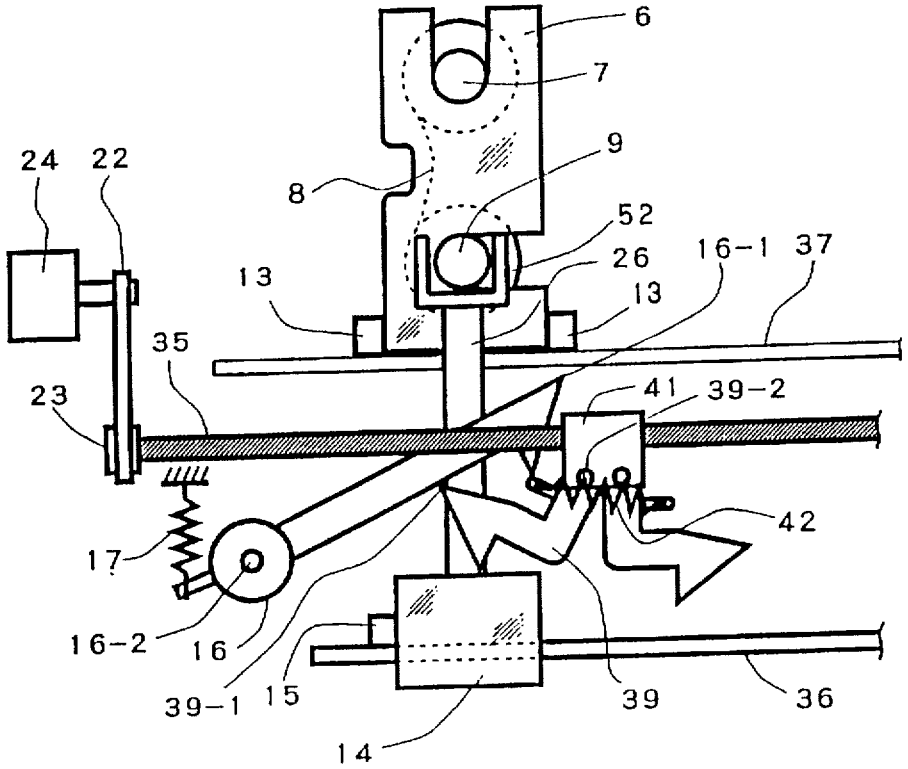
FIG. 24 is a schematic view of the thermal transfer printing apparatus of FIG. 21.
Figure 25:
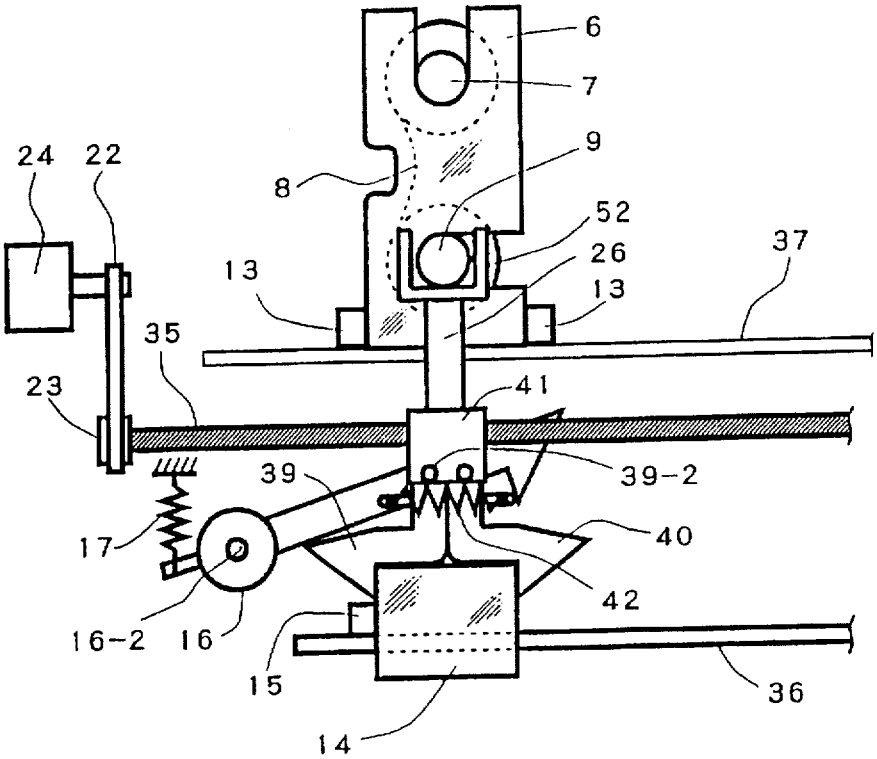
FIG. 25 is a schematic view of the thermal transfer printing apparatus of FIG. 21.
Figure 26:
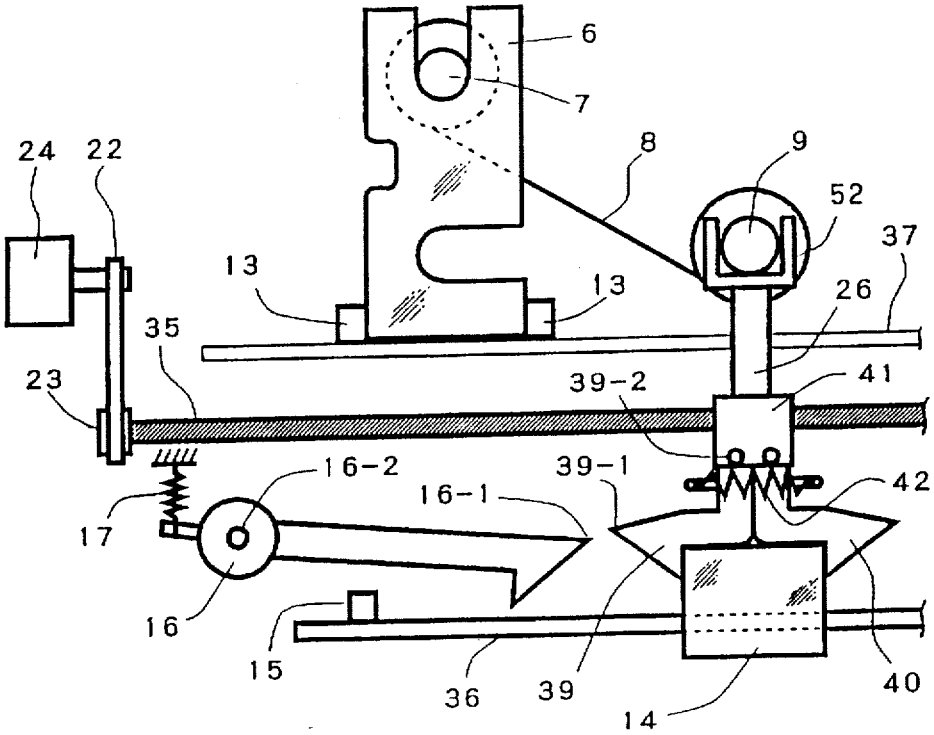
FIG. 26 is a schematic view of the thermal transfer printing apparatus of FIG. 21.

When the carriage 43 is moved in the direction of arrow A from the state shown in FIG. 23, the tip end 39-1 is brought into engagement with the lower surface of the tip end 16-1 of the arm 16, and as a result the tip end 16-1 is moved up to release the first carrier 14 as shown in FIG. 24. When the carriage 43 is moved further in the direction of arrow A, the moving arm 39 engages with the left side of the first carrier 14 and then the moving arm 40 engages with the right side of the first carrier 14, so that the first carrier 14 is held by the moving arms 39 and 40 as shown in FIG. 25. In this state, when the lead screw 35 is rotated reversely, the first carrier 14 which holds the take-up side core 9 of the first ink sheet 8 is separated from the first stock portion to transfer the first ink sheet 8 to a predetermined position beyond the printing portion so as to extend the ink sheet 8 over the printing portion.

Figure 27:
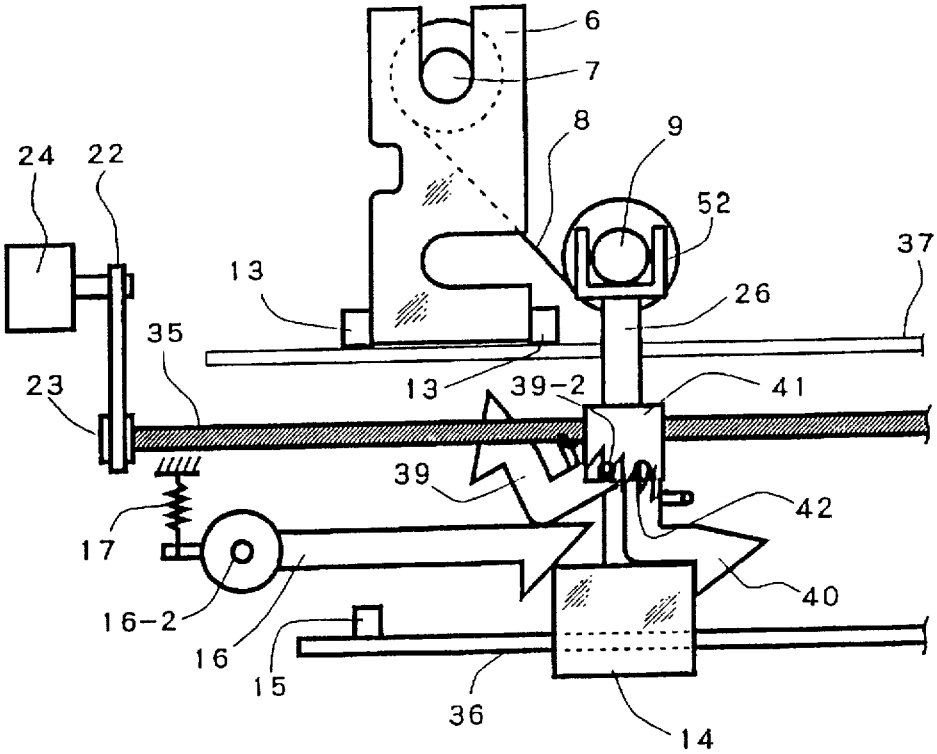
FIG. 27 is a schematic view of the thermal transfer printing apparatus of FIG. 21.
Figure 28:
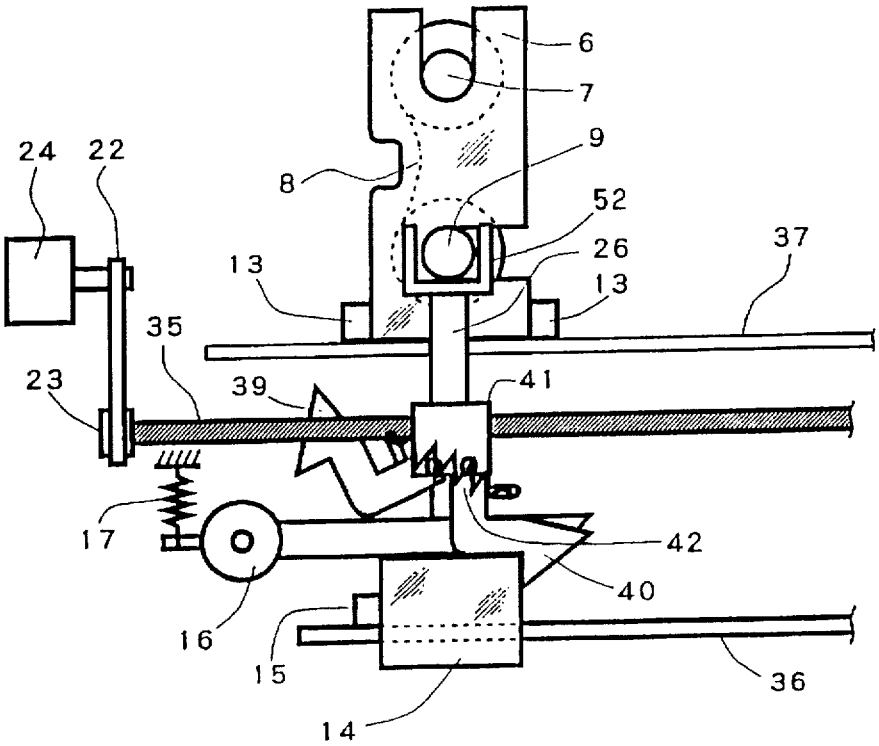
FIG. 28 is a schematic view of the thermal transfer printing apparatus of FIG. 21.
Figure 29:
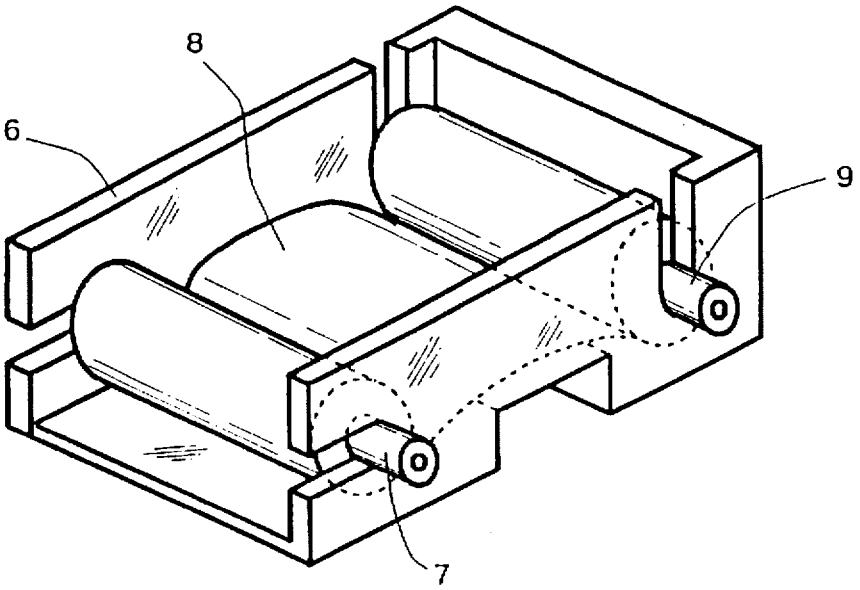
FIG. 29 s a perspective view of an ink sheet cassette for use in the thermal transfer printing apparatus of FIG. 21.

The take-up side core 9 of the first ink sheet is returned to the first stock portion after the predetermined printing operation at the printing portion has been completed, as explained hereunder. In a state shown in FIG. 26, the first carrier 14 is held by the moving arms 39 and 40 of the carriage 43 and separated from the first stock portion, and the tip end 16-1 of the arm 16 is lower than the tip end 39-1 of the arm 39. In this state, when the carriage 43 is moved in the direction of arrow A, the tip end 16-1 of the arm 16 is brought into engagement with the lower surface of the tip end 39-1 of the arm 39, and as a result the arm 39 is moved up as shown in FIG. 27. When the carriage 43 is moved further in the direction of arrow A, the carriage 14 is held between the stopper 15, and the tip end 16-1 of the arm 16 in the first stock portion and the take-up side core 9 is stored into the ink sheet cassette 6 as shown in FIG. 28. In this movement, the looseness of the ink sheet is absorbed by the operation described above. In this state, when the lead screw 35 is rotated reversely, only the carriage 43 is moved in the direction of arrow B as shown in FIG. 23.

Similarly to the taking out and returning of the take-up side core 9 of the first ink sheet 8 shown in FIGS. 21–28, the taking out and returning of the take-up side core 48 of the second ink sheet 12 are carried out by moving the carriage 43 in the direction of arrow B by the rotation of the lead screw 35 and by engaging the moving arm 40 of the carriage 43 with the arm 20 at the second stock portion. Thus, both the fusion type and sublimation type thermal transfer printings can be used, and many modes of the thermal transfer printings can be executed by using the combination of the first ink sheet cassette 6 including the first ink sheet 8 and the second ink sheet cassette 10 including the second ink sheet 12.

As stated above, according to the above-mentioned embodiment of the present invention, the thermal transfer printing apparatus comprises the thermal head including a plurality of heating elements, the platen roller to which said thermal head is urged selectively, the printing portion at which ink on the ink sheet is printed by the thermal energy produced when said heating elements are conducted on the recording paper inserted between said thermal head and said platen roller, the first stock portion for storing therein the first ink sheet cassette including the supply and the take-up side cores of the first ink sheet substantially vertically, the second stock portion for storing therein the second ink sheet cassette including supply and the take-up side cores of the second ink sheet substantially vertically, means for selecting one of the take-up side cores of said first ink sheet and said second ink sheet to carry out the thermal transfer printing, the first carrier for engaging with the core of the first ink sheet at the first stock portion and first extending the ink sheet over the printing portion, and returning it in the first stock portion after the printing, and the second carrier for engaging with the core of the second ink sheet cassette at the second stock portion and extending the second ink sheet over the printing portion, and restoring it in the second stock portion after the printing, and the driving device for driving said first and second carriers. Accordingly, a thermal transfer printing apparatus inexpensive and small in size can be obtained. In this apparatus, the ink sheet can be handled easily and a plurality of ink sheets can be interchanged with small power. Further, the space for the ink sheet cassettes in the thermal transfer printing apparatus of the present invention can be reduced, because such an ink sheet cassette that the supply and take-up side cores are stored vertically.

Another embodiment of the present invention will be explained with reference to FIGS. 30–35. Parts of the apparatus which are similar to corresponding parts of the apparatus of said embodiment have been given corresponding reference numerals and need not be further redescribed.

The positioning groove of a first ink sheet cassette 6 is fitted with the cassette positioning boss 32 formed on a cassette supporting plate 37 so that the first ink sheet cassette 6 is stored.

Figure 30:
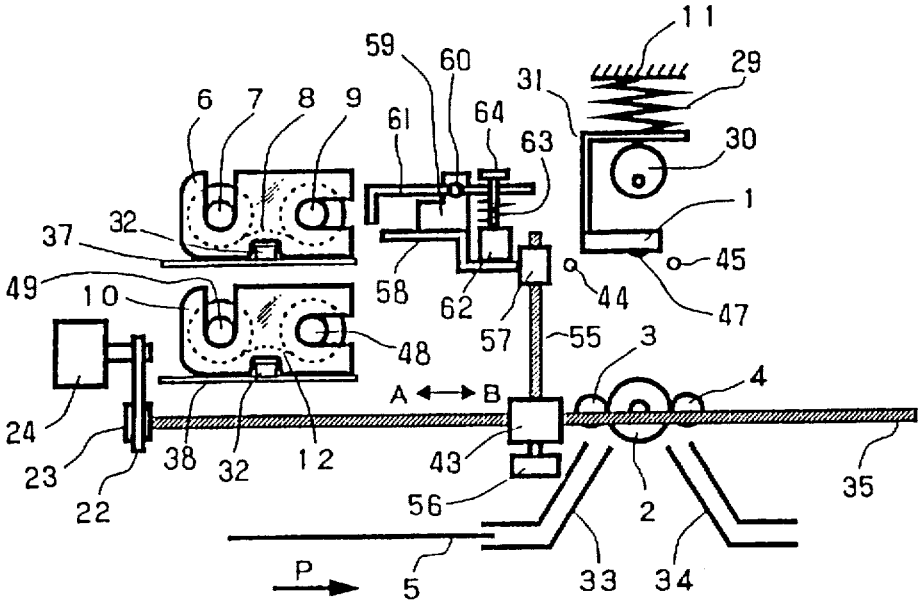
FIG. 30 is a schematic view of a thermal transfer printing apparatus according to the other embodiment of the present invention.

As shown in FIG. 30, the first ink sheet cassette 6 including the ink sheet 8 is stored in the first stock portion arranged at the up-stream side of the cassette forwarding direction shown by an arrow P with respect to the printing portion which is composed of a thermal head 1 and a platen roller 2. Similarly, the second ink sheet cassette 10 is stored on the cassette supporting plate 38 arranged at the lower stage of said cassette supporting plate 37. A supply side core of each of said ink sheets 8 and 12 is connected to an ink sheet forwarding mechanism. In this state, each of the take-up side cores 9 and 48 of said ink sheets 8 and 12 is detachable from each of said ink sheet cassettes 6 and 10 in the direction shown by an arrow B, respectively.

The carriage 43 of an ink sheet cassette selecting mechanism is moved by the lead screw 35. The lead screw 35 is rotated by the carriage motor 24, the timing belt 22 and the timing pully 23 with teeth fixed on one end of said lead screw 35. When the lead screw 35 is rotated, the carriage 43 is moved linearly in the directions shown by the arrows A and B according to the rotary direction of the lead screw 35. Similarly, a lead screw 55 is provided normally to said lead screw 35, and rotated by a vertical drive motor 56. According to the rotary direction of the lead screw 55, a core holding block 57 is moved up and down.

The core holding block 57 comprises a holding stationary plate 58, an arm supporting block 59 fixed to said holding stationary plate 58, a movable arm 61 with L shaped tip end rotatable centering around a supporting pin 60 formed on said arm supporting block 59, a solenoid 62 for moving an end of said movable arm 61 up and down to rotate said L shaped tip end of the movable arm 61 in a predetermined angular position, and an arm spring 63 urging said movable arm 61 to reduce always a gap formed between the L shaped tip end of the movable arm 61 and the holding stationary plate 58. The spring force of said arm spring 63 is so determined that the core held by the movable arm 61 can be rotated by the ink sheet forwarding mechanism. Said core holding block 57 is moved facing to the take-up side core 9 of the ink sheet 8 stored in the first ink sheet cassette 6 as shown in FIG. 30, and a plunger 64 is pulled against the spring force of the arm spring 63 when the solenoid 62 is energized.

As a result, an end of the movable arm 61 engaged with the plunger 64 formed on the tip end of the plunger 64 is moved downwards at the same time, but the L shaped tip end of the movable arm 61 is moved upwards, so that an opening through which the take-up side core 9 can be passed is formed therebetween. In this state, the core holding block 57 is moved further in the direction A to pass the take-up side core 9 through the opening, and then the solenoid 62 is deenergized, so that the L shaped tip end of the movable arm 61 is lowered by the spring action of the arm spring 63 to hold the take-up side core 9. After that, the core holding block 57 is lowered by such a distance that the roll of the ink sheet 8 can be passed through the space under side of the thermal head 1, and then moved horizontally in the direction of arrow B to extend the ink sheet 8 over the thermal head 1. Then, an ink sheet forwarding mechanism (not shown) is connected to the take-up side core 9.

Figure 31:
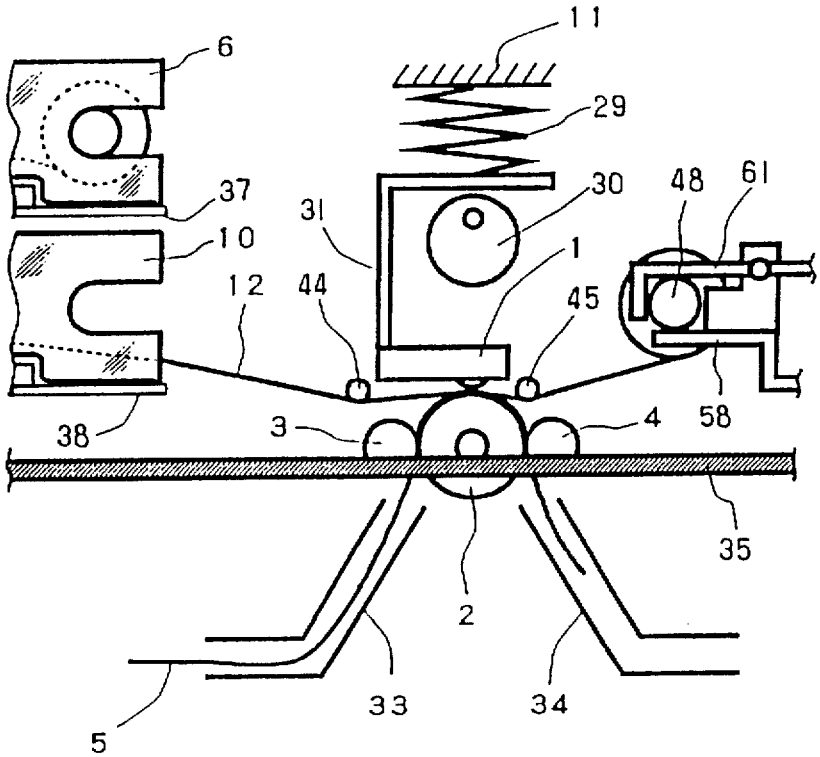
FIG. 31 is a schematic view of the thermal transfer printing apparatus of FIG. 30.

FIG. 31 shows mainly the recording portion in order to explain the actual printing using a required ink sheet. In case that the printing is carried out by using an ink sheet 12 stored in the second ink sheet cassette 10, for example, the thermal head 1 is lifted so as to be able to pass the roll of the ink sheet taken out at first through a space underside of the thermal head 1, a take-up side core 48 of the ink sheet 12 is taken out of the second ink sheet cassette 10 by the combination of the movement of the carriage 43 in the horizontal direction, the movement of the core holding block 57 in the vertical direction, and the rotary action of a rotary arm 61. Further, the carriage 43 is moved over the platen roller 2 and stopped, and then the ink sheet forwarding mechanism (not shown) is connected to the take-up side core 48.

Figure 32:
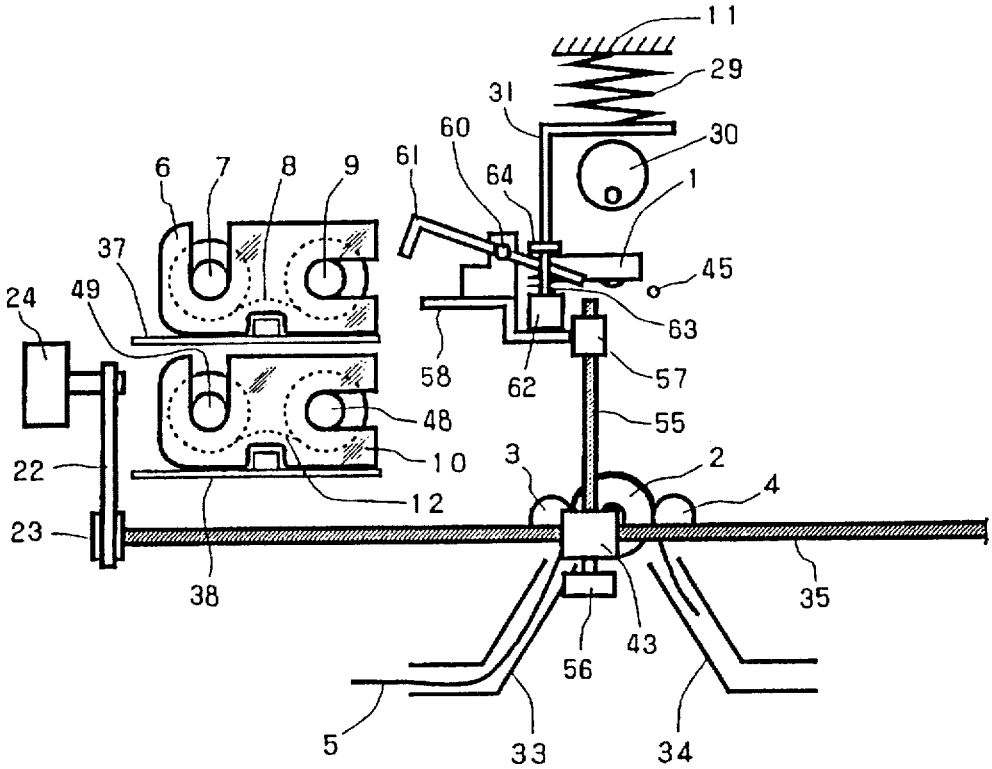
FIG. 32 is a schematic view of the thermal transfer printing apparatus of FIG. 30.

The take up process of the core of the ink sheet 8 to carry out the recording using the ink sheet after the recording used the ink sheet 12 will be explained detailedly hereunder. FIG. 32 shows such a state in which the opening portion of the movable arm 61 mounted on the core holding block 57 is faced to the first ink sheet cassette 6 in order to taking out the take-up side core 9. The carriage 43 is moved in the leftward direction in FIG. 32 by the rotation of the lead screw 35 driven by the carriage motor 24. At the same time, the opening portion of the movable arm 61 mounted on the core holding block 57 is moved up to face to the core 9 of the ink sheet 8 by the rotation of the lead screw 55 driven by the vertical drive motor 56 and stops. The L-shaped tip end of the movable arm 61 is opened by energizing the solenoid 62 at this stop position. In such state that the tip end of the movable arm 61 is opened, the carriage 43 is further moved in the leftward direction to a position where the L-shaped tip end of the movable arm 61 can be brought into engagement with the take-up side core 9, and then the solenoid 62 is deenergized. AS a result, the opening of the tip end of the movable arm 61 is reduced by the spring action of the arm spring 63, so that the take-up side core 9 is caught by the core holding block 57.

Figure 33:
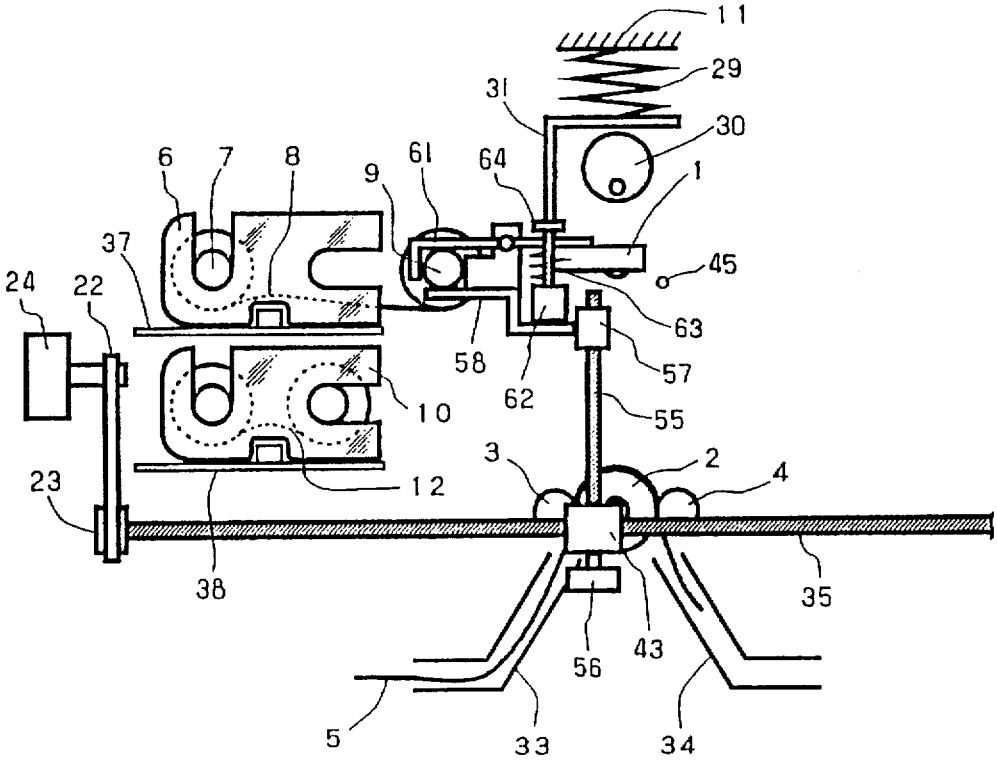
FIG. 33 is a schematic view of the thermal transfer printing apparatus of FIG. 30.

FIG. 33 shows such a state that the carriage 43 is moved in the rightward direction so that the take-up side core 9 is separated fully from the first ink sheet cassette 6. At this stage, it is necessary to pay out of the ink sheet 8 because the distance between the supply side core 7 and the take-up side core 9 is increased. Such pay out of the ink sheet 8 can be carried out by limiting the rotation of the supply side core 7 and rotating freely the take-up side core 9, or the ink sheet 8 can be paid out by rotating the supply side core 7 using an ink sheet forwarding mechanism (not shown). However, in order to prevent cutting of the ink sheet 8, it should be paid attention to the tension applied to the ink sheet.

Figure 34:
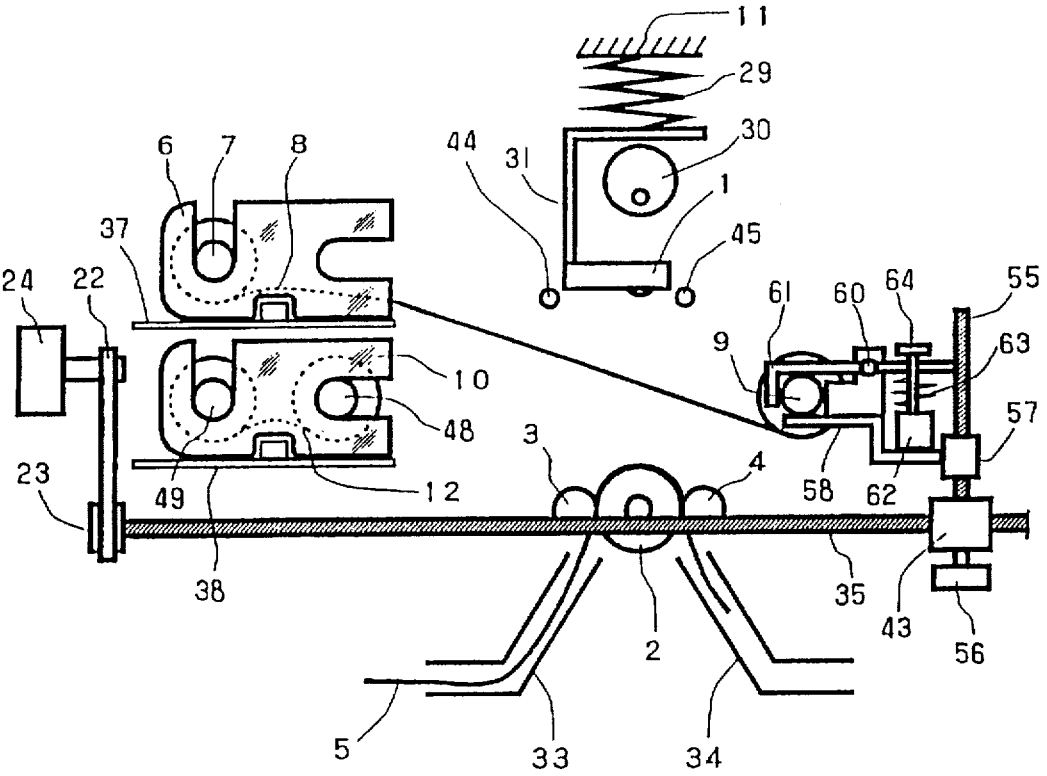
FIG. 34 is a schematic view of the thermal transfer printing apparatus of FIG. 30.
Figure 35:
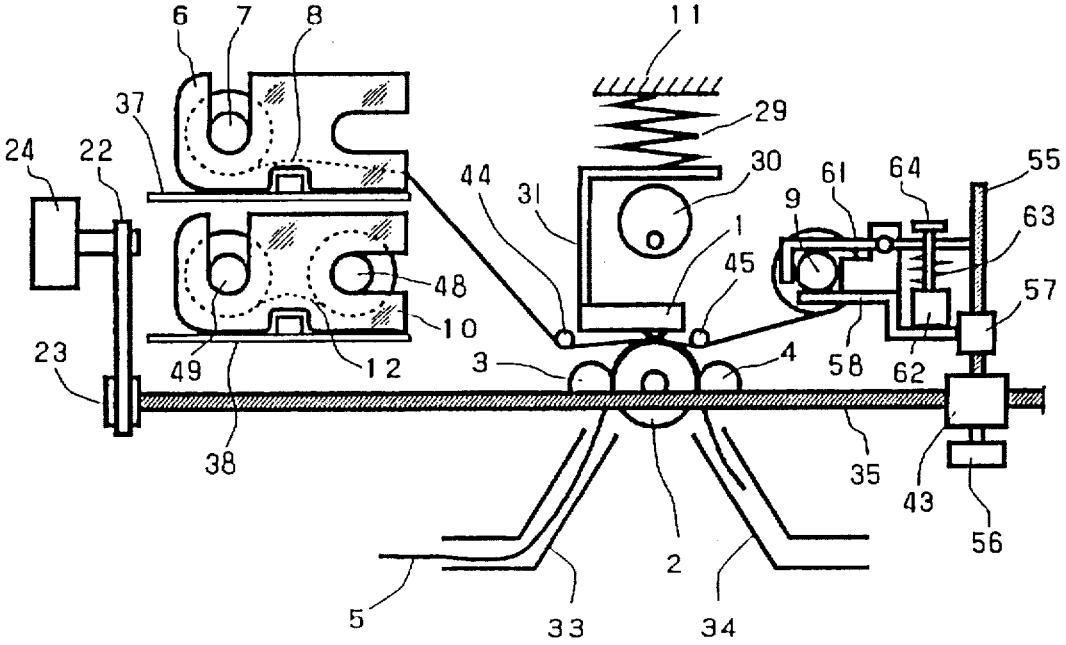
FIG. 35 is a schematic view of the thermal transfer printing apparatus of FIG. 30.

The core holding block 57 holding the take-up side core 9 is lowered so that the take-up side role of the ink sheet 8 can pass below the thermal head 1, and then moved in the rightward direction below the thermal head 1 and stopped as shown in FIG. 34 to complete the extension of the ink sheet 8 over the platen roller 2. After the completion of the extension of the ink sheet 8, the take-up side core 9 is connected to the ink sheet forwarding mechanism of the recording apparatus (not shown), and the thermal head 1 is lowered as shown in FIG. 35 to carry out the thermal transfer printing as like as the former embodiments.

At this stage, it is possible to carry out the partial printing by using the ink sheet 8 on the recording paper 5 on which the partial printing using the ink sheet 12 has been completed, because the recording paper 5 on which the printing using the ink sheet 12 has been completed is still wound around the platen roller 2. It is further possible to carry out the printing by using the ink sheet 8 on a recording paper newly supplied, after the recording paper on which the printing using the ink sheet 12 has been completed is discharged. Thus, both the fusion type and sublimation type thermal transfer printings can be used, and many modes of the thermal transfer printings can be executed by using the combination of the first ink sheet cassette 6 including the first ink sheet 8 and the second ink sheet cassette 10 including the second ink sheet 12. The above explanation is related to such a case the cassette stock portion is arranged at the up-stream side of the cassette forwarding direction with respect to the printing portion. However, it is possible to obtain the same functions in case that the cassette stock portion is arranged at the down-stream side of the cassette forwarding direction with respect to the printing portion, and that the supply side core of the ink sheet is taken out and extended over the printing portion.

As stated above, according to the above-mentioned embodiment of the present invention, the thermal transfer printing apparatus comprises the thermal head including a plurality of heating elements, the platen roller to which said thermal head is urged selectively, the printing portion at which ink on the ink sheet is printed by the thermal energy produced when said heating elements are conducted on the recording paper inserted between said thermal head and said platen roller, the plural ink sheet cassettes stacked to one another and arranged at the up-stream or down-stream side of the cassette forwarding direction with respect to the printing portion, each of which including an ink sheet, and the core holding means movable up and down, and horizontally to face to the core of the ink sheet selected according to the thermal transfer printing signal, wherein the thermal printing is carried out by extending the core held by the core holding means over the printing portion, and said core is restored in the original ink sheet cassette after the printing. Accordingly, a thermal transfer printing apparatus easy to handle and loading the ink sheet, inexpensive and small in size can be obtained. In this apparatus, further, the ink sheet can be extended with small power.

What is claimed is:

1. A thermal transfer priming apparatus comprising:

a thermal head including a plurality of heating elements, a platen roller to which said thermal head is urged selectively, a printing portion at which ink on an ink sheet is printed by thermal energy produced when said heating elements are conducted on a recording paper which is inserted, by movement in a recording paper transferring direction, between said thermal head and said platen roller;

a plurality of ink sheet cassettes each storing therein an ink sheet; and means for selectively transferring a desired ink sheet cassette, in the recording paper transferring direction, to the printing portion for thermal transfer printing.

2. A thermal transfer priming apparatus according to claim 1, wherein said means for selectively transferring comprises a carrier which forwards said desired ink sheet cassette to said printing portion from a stock portion for storing therein said plural ink sheet cassettes, and which returns said desired ink sheet cassette to said stock portion after a printing operation.

3. A thermal transfer printing apparatus according to claim 2, wherein said ink sheet cassettes are arranged substantially horizontally in said stock portion.

4. A thermal transfer printing apparatus according to claim 2, wherein said ink sheet cassettes are arranged substantially vertically in said stock portion.

5. A thermal transfer printing apparatus according to claim 1, wherein said ink sheet cassettes are stacked one above the other.

6. A thermal transfer printing apparatus as defined in claim 5, wherein said means for selectively transferring comprises a carrier which is movable in the recording paper transferring direction; and a core holding block which is mounted on said carrier so as to be movable with respect thereto in a direction perpendicular to the recording paper transferring direction, which selectively grasps and releases the selected ink sheet take-up core, and which is operable, in conjunction with the carrier, to transfer the desired ink sheet take-up core from an associated one of the ink sheet cassettes to the printing portion.

7. A thermal transfer printing apparatus as defined in claim 1, wherein said means for selectively transferring comprises a carrier to which the desired ink sheet cassette is coupled such that the desired ink sheet cassette moves with the first carrier; and a carriage which is movable in the recording paper transferring direction, which selectively grasps and releases the carrier, and which selectively moves the carrier and the desired ink sheet cassette between the printing portion and a stock position located remote from the printing portion.

8. A thermal transfer printing apparatus comprising:

a thermal head including a plurality of heating elements, a platen roller to which said thermal head is urged selectively, a printing portion at which ink on an ink sheet is printed by thermal energy produced when said heating elements are conducted on a recording paper inserted between said thermal head and said platen roller;

a plurality of ink sheet cassettes each storing therein an ink sheet; and means for selectively transferring a desired ink sheet cassette, in a direction normal to a longitudinal direction of extension of the heating element of the thermal head, to the printing portion for thermal transfer printing.

9. A thermal transfer printing apparatus comprising:

a thermal head including a plurality of heating elements, a platen roller to which said thermal head is urged selectively, a printing portion at which ink on an ink sheet is printed by thermal energy produced when said heating elements are conducted on a recording paper which is inserted, by movement in a recording paper transferring direction, between said thermal head and said platen roller;

a plurality of ink sheet cassettes each storing therein an ink sheet and an ink sheet take-up core on which the ink sheet is windable; and means for selectively transferring a selected ink sheet take-up core, in the recording paper transferring direction, from a selected one of the ink sheet cassettes to the printing portion for thermal transfer printing.

10. A thermal transfer printing apparatus according to claim 9, wherein said means for selectively transferring comprises a carrier which forwards said desired ink sheet take-up core to said printing portion from a stock portion for storing therein said plural ink sheet cassettes, and which returns said desired ink sheet take-up core to said stock portion after a printing operation.

11. A thermal transfer priming apparatus according to claim 10, wherein said ink sheet take-up cores are arranged substantially horizontally in said stock portion.

12. A thermal transfer printing apparatus according to claim 10, wherein said ink sheet take-up cores are arranged substantially vertically in said stock portion.

13. A thermal transfer printing apparatus according to claim 9, wherein said ink sheet cassettes are stacked one above the other.

14. A thermal transfer printing apparatus as defined in claim 9, wherein said ink-sheet cassettes are stored in a stock portion located remote from the printing portion, and wherein said means for selectively transferring comprises a carrier to which the desired ink sheet take-up core is coupled such that the desired ink sheet take-up core moves with said first carrier; and a carriage which is movable in the recording paper transferring direction, which selectively grasps and releases the carrier, and which selectively moves the carrier and the desired ink sheet take-up core between an associated one of the ink sheet cassettes and the printing portion.

15. A thermal transfer printing apparatus comprising:

a thermal head including a plurality of heating elements, a platen roller to which said thermal head is urged selectively, a printing portion at which ink on an ink sheet is printed by thermal energy produced when said heating elements are conducted on a recording paper inserted between said thermal head and said platen roller;

a plurality of ink sheet cassettes each storing therein an ink sheet and an ink sheet take-up core on which the ink sheet is windable; and means for transferring a selected ink sheet take-up core, in a direction normal to a longitudinal direction of extension of the heating elements of the thermal head, from a selected one of the ink sheet cassettes to the printing portion for thermal transfer printing.

* * * * *